US007579139B2

(12) United States Patent
Sakai et al.

(10) Patent No.: US 7,579,139 B2
(45) Date of Patent: Aug. 25, 2009

(54) SILVER HALIDE COLOR PHOTOGRAPHIC LIGHT-SENSITIVE MATERIAL

(75) Inventors: Hidekazu Sakai, Minami-ashigara (JP); Shin Soejima, Minami-ashigara (JP); Shinji Tanaka, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 262 days.

(21) Appl. No.: 11/644,911

(22) Filed: Dec. 26, 2006

(65) Prior Publication Data

US 2007/0172778 A1 Jul. 26, 2007

(30) Foreign Application Priority Data

Dec. 26, 2005 (JP) ..... 2005-373473

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/005*** | (2006.01) |
| ***G03C 1/494*** | (2006.01) |

(52) U.S. Cl. ..... 430/546; 430/502; 430/503; 430/517; 430/519; 430/559; 430/561; 430/551; 430/934; 430/631; 430/634; 430/635; 430/636

(58) Field of Classification Search ..... 430/502, 430/503, 517, 519, 559, 561, 546, 551, 934, 430/631, 634–636

See application file for complete search history.

(56) References Cited

U.S. PATENT DOCUMENTS

| | | | | |
|---|---|---|---|---|
| 4,294,916 | A | 10/1981 | Postle et al. | |
| 4,294,917 | A | 10/1981 | Postle et al. | |
| 6,518,006 | B2 * | 2/2003 | Sakai et al. | 430/517 |
| 6,815,152 | B2 * | 11/2004 | Takada et al. | 430/502 |

FOREIGN PATENT DOCUMENTS

| | | |
|---|---|---|
| EP | 0 015 601 B1 | 5/1983 |
| EP | 0 276 566 A1 | 8/1988 |
| JP | 55-92716 | 7/1980 |
| JP | 55-155350 | 12/1980 |
| JP | 55-155351 | 12/1980 |
| JP | 63-27838 | 2/1988 |
| JP | 63-197943 | 8/1988 |
| JP | 64-40827 | 2/1989 |
| JP | 2-282244 | 11/1990 |
| JP | 11-95371 | 4/1999 |
| WO | WO 88/04794 | 6/1988 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material, in which a non-light-sensitive hydrophilic colloidal layer, on a transmission-type support, contains a solid fine-particle dispersion of a dye represented by formula (I), any one of photographic constituting layers contains a compound represented by formula (A) and/or a compound represented by formula (B) or (FS-2), and the light-sensitive material does not contain any compound represented by formula (C):

Formula (I)

Formula (A)

Formula (B)

Formula (F S-2)

Formula (C)

in formulas (I), (A), (B) and (C), D represents a group to give a compound having a chromophore; X represents a dissociable hydrogen or a group having a dissociable hydrogen; y is an integer from 1 to 7; $R^1$ represents a substituted or unsubstituted alkyl or alkoxy group; $R^2$ and $R^3$ each independently represent a substituted or unsubstituted alkyl group; $R^4$ represents a substituted or unsubstituted alkyl group; M, $M^1$, $M^2$ and $M^3$ each independently represent a cation; n represents an integer of 1 to 7; A and B each independently represent a fluorine atom or a hydrogen atom; a and b each independently represent an integer of from 1 to 6; and c and d each independently represent an integer of from 4 to 8.

11 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material excellent in storability and uniformity for quality when it is processed at a laboratory. In particular, the present invention relates to a silver halide color photographic light-sensitive material for cinema.

BACKGROUND OF THE INVENTION

In a movie, which is an application of silver halide photographic technique, subjects are photographed usually at a rate of 24 photographs per second, and then the resultant static images are projected on a screen successively at the same rate as that of photographing, thereby reproducing moving images on the screen. This method is based on silver halide photographic technique that continues to be improved over 100 years or more, and this method gives much higher quality for moving images than those of any other method for reproducing the images. Further, because the images can be enlarged in a screen with ease by virtue of this high quality of images, the method is suitable for appreciation of moving-images by a great number of people simultaneously. Therefore, a large number of theaters are established that have facilities for projecting pictures onto a large screen which allows a large number of people to appreciate the picture: a movie theater. However, for all processes from photographing through edition to screening, recently rapid developments of electronic technique and information processing technique are proposed as alternative means, which means can give quality for images that is equivalent to the conventional method, by utilizing digital image processing techniques. These means based on the digital image processing technique are characterized in that images can be easily handled though the progress of computers and good reproducibility can be attained on the basis of the characteristic of digital signals that are hardly deteriorated. Accordingly, for the movie based on silver halide photographic technique also, desired is acquisition of easiness or stability at processing laboratories while original quality is kept high. In particular, stability against storage or fluctuations of a developing solution is desired.

One important property out of photographic properties is the change of density of the white portion in a developed image, when a photograph is stored or a developing solution fluctuates.

Hitherto, a countermeasure against the fluctuation in the density of the white portion has been taken up as an important problem to be solved. The problem has been investigated mainly from the following viewpoints:

(1) Promotion of an outflow of a sensitizing dye and a dye at a washing step for preventing halation or irradiation for the purpose of promoting removal of unnecessary coloring ingredients, and (2) Search for compounds which have good influence on a light-sensitive silver halide emulsion and restrain fogging.

Regarding light-sensitive materials for movie-photographs, which are enlarged and projected on a screen for appreciation, sharpness of an image is an important requirement in quality. In order to improve the sharpness, it is effective to use the above-described dye for preventing halation or irradiation. Therefore, proposed are various water-soluble dyes for preventing irradiation as described in, for example, JP-A-2-282244 ("JP-A" means unexamined published Japanese patent application), and various halation-preventing methods based on a dye-fixing manner as described in, for example, JP-A-11-95371, JP-A-55-155350, JP-A-55-155351, JP-A-55-92716, JP-A-63-197943, JP-A-63-27838, JP-A-64-40827, EP 15601 B1, EP 276566 A1, and WO 88/04794. However, any one of those is insufficient in order to prevent the white portion from fluctuation of density.

In particular, JP-A-2-282244 and JP-A-11-95371 each propose a dye which is dispersed, in a solid dispersion state, in a hydrophilic colloidal layer to remain in the layer and is easily removed by development in order to aim compatibility between prevention of a fluctuation of density of the white portion and halation-prevention based on the fix of dyes. However, the dye is insufficient for preventing the white portion from density fluctuation, in particular the density fluctuation after a long-time storage.

SUMMARY OF THE INVENTION

The present invention resides in a silver halide color photographic light-sensitive material, comprising, on a transmission-type support, at least one yellow-color-forming light-sensitive silver halide emulsion layer, at least one cyan-color-forming light-sensitive silver halide emulsion layer, at least one magenta-color-forming light-sensitive silver halide emulsion layer, and at least one non-light-sensitive hydrophilic colloidal layer, wherein the at least one non-light-sensitive hydrophilic colloidal layer comprises a solid fine-particle dispersion of a dye represented by formula (I), wherein any one of the light-sensitive silver halide emulsion layers and the non-light-sensitive hydrophilic colloidal layer comprises at least one compound represented by formula (A) and/or at least one compound represented by formula (B), and wherein the silver halide color photographic light-sensitive material does not comprise any compound represented by formula (C):

$$D\text{-}(X)_y \qquad \text{Formula (I)}$$

wherein, in formula (I), D represents a group to give a compound having a chromophore; X represents a dissociable hydrogen or a group having a dissociable hydrogen; y is an integer from 1 to 7; and when y is 2 or more, plural X's may be the same or different from each other;

Formula (A)

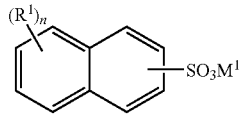

wherein, in formula (A), $R^1$ represents a substituted or unsubstituted alkyl or alkoxy group; $M^1$ represents a cation; n represents an integer of 1 to 7; and when n is 2 to more, plural $R^1$'s may be the same or different;

Formula (B)

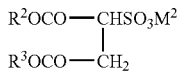

wherein, in formula (B), $R^2$ and $R^3$ each independently represent a substituted or unsubstituted alkyl group, and $M^2$ represents a cation; and Formula (C)

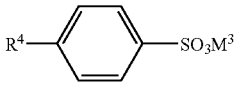

wherein, in formula (C), $R^4$ represents a substituted or unsubstituted alkyl group, and $M^3$ represents a cation Other and further features and advantages of the invention will appear more fully from the following description.

DETAILED DESCRIPTION OF THE INVENTION

The inventors have made eager investigations about the above-mentioned problems, so as to find out that it is important to not only select an appropriate dye, which is related to the prior art, but also select an appropriate surfactant in order to keep certain uniformity for finished photograph at a processing laboratory, in particular stability of density of white portions regardless of a storage time of the material. The inventors have further found out that when a fluorine-series surfactant having a specific structure is used as the surfactant contained in a light-sensitive material, the storability of the material is further improved. Thus, the present invention has been made based on these findings.

The surfactant is widely used in a silver halide color photographic light-sensitive material. For example, the surfactant is used as a dispersion stabilizer when a water-insoluble color-forming agent (the so-called color coupler) or the like is oil-in-water-dispersed in gelatin, or as a surface tension adjuster when each of light-sensitive silver halide emulsion layers or a non-light-sensitive hydrophilic colloidal layer is applied to a support.

According to the present invention, there is provided the following means:

(1) A silver halide color photographic light-sensitive material, comprising, on a transmission-type support, at least one yellow-color-forming light-sensitive silver halide emulsion layer, at least one cyan-color-forming light-sensitive silver halide emulsion layer, at least one magenta-color-forming light-sensitive silver halide emulsion layer, and at least one non-light-sensitive hydrophilic colloidal layer, wherein the at least one non-light-sensitive hydrophilic colloidal layer comprises a solid fine-particle dispersion of a dye represented by formula (I), wherein any one of the light-sensitive silver halide emulsion layers and the non-light-sensitive hydrophilic colloidal layer comprises at least one compound represented by formula (A) and/or at least one compound represented by formula (B), and wherein the silver halide color photographic light-sensitive material does not comprise any compound represented by formula (C):

$D\text{-}(X)_y$ Formula (I)

wherein, in formula (I), D represents a group to give a compound having a chromophore; X represents a dissociable hydrogen or a group having a dissociable hydrogen; y is an integer from 1 to 7; and when y is 2 or more, plural X's may be the same or different from each other;

Formula (A)

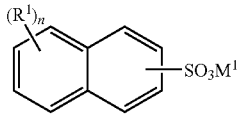

wherein, in formula (A), $R^1$ represents a substituted or unsubstituted alkyl or alkoxy group; $M^1$ represents a cation; n represents an integer of 1 to 7; and when n is 2 to more, plural $R^1$'s may be the same or different;

Formula (B)

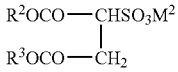

wherein, in formula (B), $R^2$ and $R^3$ each independently represent a substituted or unsubstituted alkyl group, and $M^2$ represents a cation; and Formula (C)

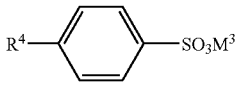

wherein, in formula (C), $R^4$ represents a substituted or unsubstituted alkyl group, and $M^3$ represents a cation; and (2) The silver halide color photographic light-sensitive material according to the above item (1), wherein in place of at least one compound represented by formula (B), a compound represented by formula (FS) is used:

Formula (FS)

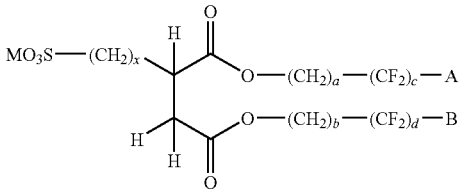

wherein A and B each independently represent a fluorine atom or a hydrogen atom; a and b each independently represent an integer of from 1 to 6; c and d each independently represent an integer of from 4 to 8; x represents 0 or 1; and M represents a cation.

The silver halide color photographic light-sensitive material of the present invention will be explained below in detail.

First, the compound represented by formula (I) will be explained in detail.

$D\text{-}(X)_y$ Formula (I)

In formula (I), D represents a group to give a compound having a chromophore, X represents a dissociable hydrogen or a group having a dissociable hydrogen, and y denotes an integer of from 1 to 7. When y is an integer of from 2 to 7, plural X's may be the same or different from each other.

The compound (dye) represented by formula (I) for use in the present invention is characterized by the point that it has a dissociable hydrogen or the like in its molecular structure.

The group (D) to give a compound having a chromophore may be selected from many well-known dyes. Examples of the compound include oxonol dyes, merocyanine dyes, cyanine dyes, allylidene dyes, azomethine dyes, triphenylmethane dyes, azo dyes, anthraquinone dyes, and indoaniline dyes.

X represents a dissociable hydrogen or group having a dissociable hydrogen which is bonded to D directly or through a divalent linking group.

The divalent linking group disposed between X and D is a divalent group including an alkylene group, allylene group, heterocyclic residue, —CO—, —$SO_n$—(n=0, 1 or 2), —NR'— (R' represents a hydrogen atom, an alkyl group, or an aryl group) and —O—, and combinations of these linking groups. Further, these groups may have a substituent, such as an alkyl group, aryl group, alkoxy group, amino group, acylamino group, halogen atom, hydroxyl group, carboxy group, sulfamoyl group, carbamoyl group or sulfonamido group. Given as preferable examples of the divalent linking group are —$(CH_2)_n$— (n'=1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociable hydrogen or group having a dissociable hydrogen represented by X is non-dissociable and has such characteristics that it makes the dye represented by formula (I) substantially water-insoluble, in such a condition that the dye represented by formula (I) is added in the silver halide photographic light-sensitive material of the present invention. In a step of development processing of the light-sensitive material, the hydrogen or group represented by X has also such characteristics that it dissociates and makes the compound represented by formula (I) substantially water-soluble. Given as examples of the group having a dissociable hydrogen represented by X are groups having a carboxylic acid group, sulfonamido group, sulfamoyl group, sulfonylcarbamoyl group, acylsulfamoyl group or phenolic hydroxyl group. Examples of the dissociable hydrogen represented by X include a hydrogen of an enol group of an oxonol dye.

A preferable range of y is from 1 to 5 and particularly preferably from 1 to 3.

Preferable examples among the compounds represented by formula (I) are those in which X, the group having a dissociable hydrogen, has a carboxylic acid group. Particularly, compounds having an aryl group substituted with a carboxyl group are preferred.

A more preferable one among the compounds represented by formula (I) is a compound represented by the following formula (II) or (III).

$$A^1{=}L^1{-}(L^2{=}L^3)_{m1}{-}Q \qquad \text{Formula (II)}$$

In formula (II), $A^1$ represents an acidic nucleus, Q represents an aryl group or a heterocyclic group, $L^1$, $L^2$ and $L^3$ each independently represents a methine group, and m1 denotes 0, 1 or 2. The compound represented by formula (II) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

$$A^1{=}L^1{-}(L^2{=}L^3)_{n1}{-}A^2 \qquad \text{Formula (III)}$$

In formula (III), $A^1$ and $A^2$ each independently represents an acidic nucleus, $L^1$, $L^2$ and $L^3$ each independently represents a methine group, and n1 denotes 0, 1, 2 or 3. The compound represented by formula (III) has, in its molecule, 1 to 7 groups selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

The compounds represented by formula (II) or (III) will be hereinafter explained in detail.

The acidic nuclei represented by $A^1$ and $A^2$ are preferably those derived from cyclic ketomethylene compounds or compounds having a methylene group sandwiched between electron attractive groups. Examples of the above cyclic ketomethylene compound may include 2-pyrazoline-5-one, rhodanine, hydantoin, thiohydantoin, 2,4-oxazolidinedione, isooxazolone, barbituric acid, thiobarbituric acid, indandione, dioxopyrazolopyridine, hydroxypyridone, pyrazolidinedione and 2,5-dihydrofuran. These compounds may have a substituent.

The compounds having a methylene group sandwiched by electron attractive groups may be represented by $Z^1CH_2Z^2$. Here, $Z^1$ and $Z^2$ each independently represents —CN, —$SO_2R^{11}$, —$COR^{11}$, —$COOR^{12}$, —$CONHR^{12}$, —$SO_2NHR^{12}$ or —$C[{=}C(CN)_2]R^{11}$. $R^{11}$ represents an alkyl group, an aryl group, or a heterocyclic group, and $R^{12}$ represents a hydrogen atom, or a group represented by $R^{11}$. These groups each may have a further substituent.

Examples of the aryl group represented by Q include a phenyl group and naphthyl group, which respectively may have a substituent. Examples of the heterocyclic group represented by Q may include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxodiazole, benzoquinoline, thiadiazole, pyrrolothiazole, pyrrolopyridazine, tetrazole, oxazole, coumarin and coumarone. These each may have a substituent.

The methine groups represented by $L^1$, $L^2$ and $L^3$ may have a substituent and these substituents may be connected to each other to form a five- or six-membered ring (e.g., cyclopentene or cyclohexene).

No particular limitation is imposed on the substituent which each of the aforementioned groups may have, as far as the substituent does not allow the compound represented by any of the above formulae (I) to (III) to dissolve in water having a pH of 5 to 7. For example, the following substituents can be mentioned.

Specifically, examples of the substituent include a carboxylic acid group, a sulfonamido group having 1 to 10 carbon atoms (e.g., methanesulfonamido, benzenesulfonamido, butanesulfonamido, and n-octanesulfonamido), an unsubstituted, or alkyl- or aryl-substituted sulfamoyl group having 0 to 10 carbon atoms (e.g., unsubstituted sulfamoyl, methylsulfamoyl, phenylsulfamoyl, naphthylsulfamoyl, and butylsulfamoyl), a sulfonylcarbamoyl group having 2 to 10 carbon atoms (e.g., methanesulfonylcarbamoyl, propanesulfonylcarbamoyl, and benzenesulfonylcarbamoyl), an acylsulfamoyl group having 1 to 10 carbon atoms (e.g., acetylsulfamoyl, propionylsulfamoyl, pivaloylsulfamoyl, and benzoylsulfamoyl), a chain or cyclic alkyl group having 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, and 2-diethylaminoethyl), an alkenyl group having 2 to 8 carbon atoms (e.g., vinyl, and allyl), an alkoxy group having 1 to 8 carbon atoms (e.g., methoxy, ethoxy, and butoxy), a halogen atom (e.g., F, Cl, and Br), an amino group having 0 to 10 carbon atoms (e.g., unsubstituted amino, dimethylamino, diethylamino, and carboxyethylamino), an ester group having 2 to 10 carbon atoms (e.g., a methoxycarbonyl), an amido group having 1 to 10 carbon atoms (e.g., acetylamino, and benzamido), a carbamoyl group having 1 to 10 carbon atoms (e.g., unsubstituted carbamoyl, methylcarbamoyl, and ethylcarbamoyl), an aryl group having 6 to 10 carbon atoms (e.g., phenyl, naphthyl, hydroxyphenyl, 4-carboxyphenyl, 3-carboxyphenyl, 3,5-dicarboxyphenyl, 4-methanesulfonamidophenyl, and 4-butanesulfonamidophenyl), an aryloxy group having 6 to 10 carbon atoms (e.g., phenoxy, 4-carboxyphenoxy, 3-methylphenoxy, and naphthoxy), an alkylthio group having 1 to 8 carbon atoms (e.g., methylthio, ethylthio, and octylthio), an arylthio group having 6 to 10 carbon atoms (e.g., phenylthio, and naphthylthio), an acyl group having 1 to 10 carbon atoms (e.g., acetyl, benzoyl, and propanoyl), a sulfonyl group having 1 to 10 carbon atoms (e.g., methanesulfonyl, and benzenesulfonyl), a ureido group having 1 to 10 carbon atoms (e.g., ureido, and methylureido), a urethane group having 2 to 10 carbon atoms (e.g., methoxycarbonylamino, and ethoxycarbonylamino), a cyano group, a hydroxyl group, a nitro group, and a heterocyclic group (e.g., 5-carboxybenzooxazole ring, pyridine ring, sulfolane ring, pyrrole ring, pyrrolidine ring, morpholine ring, piperazine ring, pyrimidine ring, and furan ring).

More preferable examples among the compounds represented by the above formula (III) are compounds represented by the following formula (IV). The compound represented by formula (IV) has a hydrogen of an enol group as a dissociable hydrogen.

Formula (IV)

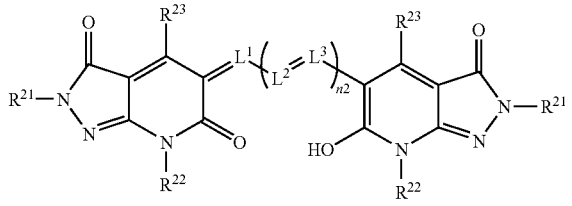

In formula (IV), $R^{21}$ represents a hydrogen atom, an alkyl group, an aryl group, or a heterocyclic group, $R^{22}$ represents a hydrogen atom, an alkyl group, an aryl group, a heterocyclic group, —$COR^{24}$ or —$SO_2R^{24}$, $R^{23}$ represents a hydrogen atom, a cyano group, a hydroxyl group, a carboxyl group, an alkyl group, an aryl group, —$CO_2R^{24}$, —$OR^{24}$, —$NR^{25}R^{26}$, —$CONR^{25}R^{26}$, —$NR^{25}COR^{24}$, —$NR^{25}SO_2R^{24}$ or —$NR^{25}CONR^{25}R^{26}$ (in which $R^{24}$ represents an alkyl group or an aryl group, and $R^{25}$ and $R^{26}$ each independently represents a hydrogen atom, an alkyl group, or an aryl group), $L^1$, $L^2$ and $L^3$ each independently represents a methine group, and n2 denotes 1 or 2.

In formula (IV), examples of the alkyl group as $R^{21}$ include an alkyl group having 1 to 4 carbon atoms, 2-cyanoethyl group, 2-hydroxyethyl group and carboxybenzyl group. Examples of the aryl group as $R^{21}$ include a phenyl group, 2-methylphenyl group, 2-carboxyphenyl group, 3-carboxyphenyl group, 4-carboxyphenyl group, 3,6-dicarboxyphenyl group, 2-hydroxyphenyl group, 3-hydroxyphenyl group, 4-hydroxyphenyl group, 2-chloro-4-carboxyphenyl group, and 4-methylsulfamoylphenyl group. Examples of the heterocyclic group as $R^{21}$ include 5-carboxybenzooxazole-2-yl group.

Examples of the alkyl group as $R^{22}$ include an alkyl group having 1 to 4 carbon atoms, carboxymethyl group, 2-hydroxyethyl group, and 2-methoxyethyl group. Examples of the aryl group as $R^{22}$ include a 2-carboxyphenyl group, 3-carboxyphenyl group, 4-carboxyphenyl group, and 3,6-dicarboxyphenyl group. Examples of the heterocyclic group as $R^{22}$ include a pyridyl group. Examples of —$COR^{24}$ as $R^{22}$ include an acetyl group, and examples of —$SO_2R^{24}$ as $R^{22}$ include a methanesulfonyl group.

Given as examples of the alkyl group as $R^{23}$, $R^{24}$, $R^{25}$ or $R^{26}$ are an alkyl group having 1 to 4 carbon atoms. Given as examples of the aryl group as $R^{23}$, $R^{24}$, $R^{25}$ or $R^{26}$ are a phenyl group and a methylphenyl group.

In the present invention, $R^{21}$ is preferably a phenyl group substituted with carboxyl group(s) (e.g., 2-carboxyphenyl group, 3-carboxyphenyl group, 4-carboxyphenyl group, and 3,6-dicarboxyphenyl group).

Specific examples of the compounds represented by any one of the above formulae (I) to (IV) are shown below, which, however, are not intended to be limiting of the present invention.

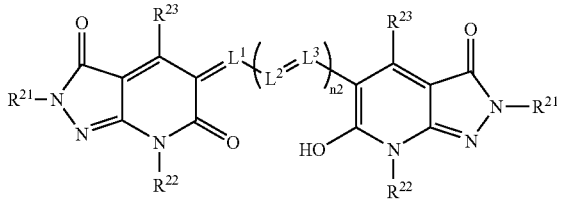

| | $R^{21}$ | $R^{22}$ | $R^{23}$ | $=L^1-(L^2=L^3)_{n2}-$ |
|---|---|---|---|---|
| IV-1 | 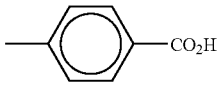 | —H | $CH_3$ | =CH—CH=CH— |
| IV-2 | 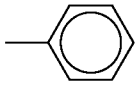 | —H | $CH_3$ | =CH—CH=CH— |
| IV-3 | $CH_3$ | —H | $CH_3$ | =CH—CH=CH— |

-continued
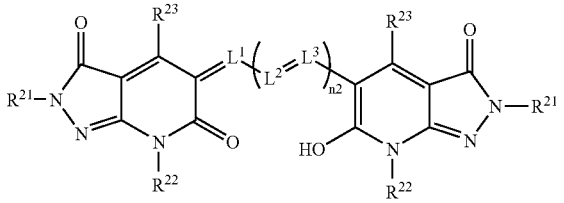
| | $R^{21}$ | $R^{22}$ | $R^{23}$ | $=L^1-(L^2=L^3)_{n2}-$ |
|---|---|---|---|---|
| IV-4 | 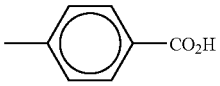 | $-CH_3$ | $CH_3$ | $=CH-CH=CH-$ |
| IV-5 | 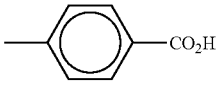 | 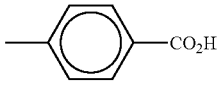 | $-CH_3$ | $=CH-CH=CH-$ |
| IV-6 | 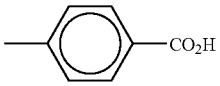 | $-CH_3$ | $-CO_2C_2H_5$ | $=CH-CH=CH-$ |
| IV-7 | 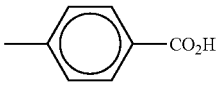 | $-CH_3$ | $-CO_2H$ | $=CH-CH=CH-$ |
| IV-8 | $-CH_3$ | 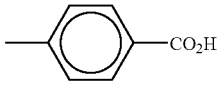 | $-CH_3$ | $=CH-CH=CH-$ |
| IV-9 | $-CH_3$ | 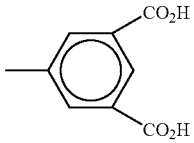 | $-CH_3$ | $=CH-CH=CH-$ |
| IV-10 | $-CH_3$ | $-CH_3$ | $-CH_3$ | $=CH-CH=CH-$ |
| IV-11 | 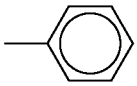 | 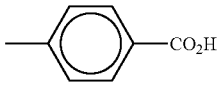 | $-CH_3$ | $=CH-CH=CH-$ |
| IV-12 | 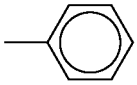 | 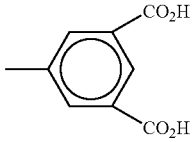 | $-CH_3$ | $=CH-CH=CH-$ |
| IV-13 | 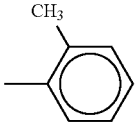 | 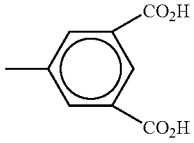 | $-CH_3$ | $=CH-CH=CH-$ |
| IV-14 | 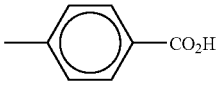 | $-H$ | $-CH_3$ | 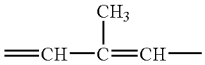 |
| IV-15 | 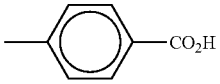 | $-H$ | $-CO_2C_2H_5$ | $=CH-CH=CH-$ |

-continued
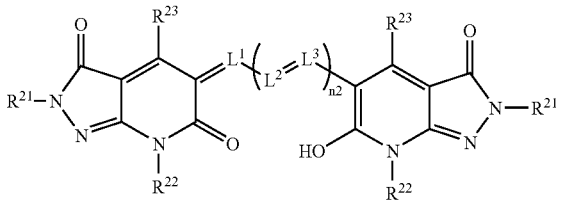
| | $R^{21}$ | $R^{22}$ | $R^{23}$ | $=L^1-(L^2=L^3)_{n2}-$ |
|---|---|---|---|---|
| IV-16 | 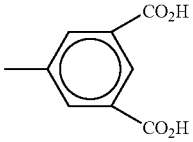 | —H | $—CO_2H$ | =CH—CH=CH— |
| IV-17 | 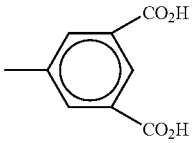 | —H | $—CH_3$ | =CH—CH=CH— |
| IV-18 | 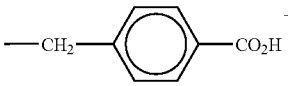 | —H | $—CH_3$ | 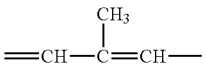 |
| IV-19 | 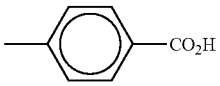 | $—CH_2CH_2OH$ | —H | =CH—CH=CH— |
| IV-20 | 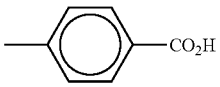 | $—CH_2CO_2H$ | $—CH_3$ | 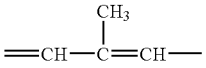 |
| IV-21 | 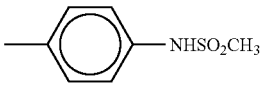 | —H | $—CH_3$ | =CH—CH=CH— |
| IV-22 | 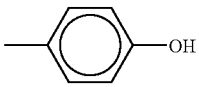 | —H | $—CH_3$ | =CH—CH=CH— |
| IV-23 | $—CH_2CH_2OH$ | —H | $—CH_3$ | =CH—CH=CH— |
| IV-24 | $—CH_3$ | $—CH_2CH_2OH$ | $—CH_3$ | =CH—CH=CH— |
| IV-25 | —H | 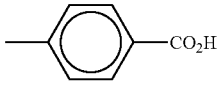 | $—CH_3$ | =CH—CH=CH— |
| IV-26 | —H | —H | $—CO_2H$ | =CH—CH=CH— |
| IV-27 | 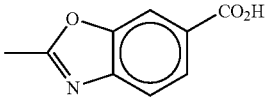 | —H | $—C_2H_5$ | =CH—CH=CH— |
| IV-28 | 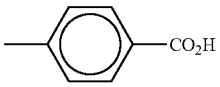 | $—SO_2CH_3$ | $—CO_2CH_3$ | 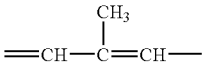 |
| IV-29 | 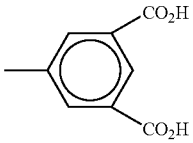 | $—COCH_3$ | $—CH_3$ | =CH—CH=CH— |

-continued
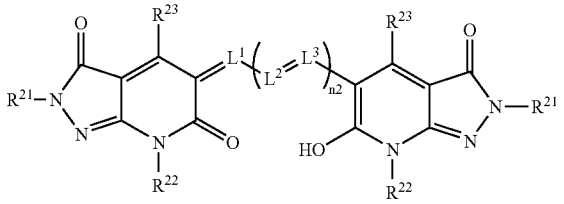
| | $R^{21}$ | $R^{22}$ | $R^{23}$ | $=L^1-(L^2=L^3)_{n2}-$ |
|---|---|---|---|---|
| IV-30 | —H | HOOC 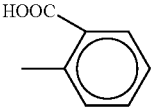 | $—CH_3$ | =CH—CH=CH— |
| IV-31 | 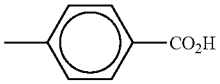 | 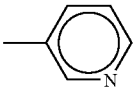 | $—CH_3$ | 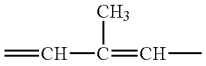 |
| IV-32 | 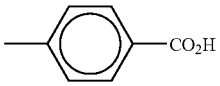 | $—CH_3$ | —CN | =CH—CH=CH— |
| IV-33 | 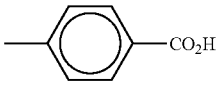 | —H | —H | =CH—CH=CH— |
| IV-34 | 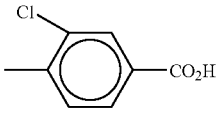 | —H | $—OC_2H_5$ | =CH—CH=CH— |
| IV-35 | 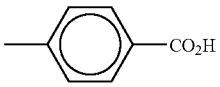 | —H | $(n)C_4H_9$— | =CH—CH=CH— |
| IV-36 | 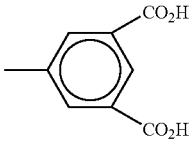 | $—CH_3$ | $—NHCH_3$ | =CH—CH=CH— |
| IV-37 | 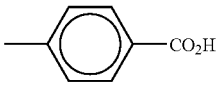 | $—COCH_3$ | $—NHCOCH_3$ | =CH—CH=CH— |
| IV-38 | 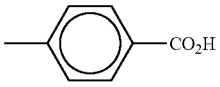 | $—CO_2CH_3$ | $—NHSO_2CH_3$ | =CH—CH=CH— |
| IV-39 | 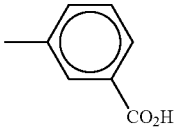 | $—CH_2CH_2OH$ | $—CH_3$ | =CH—CH=CH— |
| IV-40 | $—CH_2CH_2CN$ | —H | $—CH_3$ | =CH—CH=CH— |
| IV-41 | HOOC 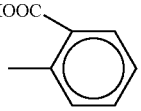 | —H | $—CH_3$ | =CH—CH=CH— |

-continued

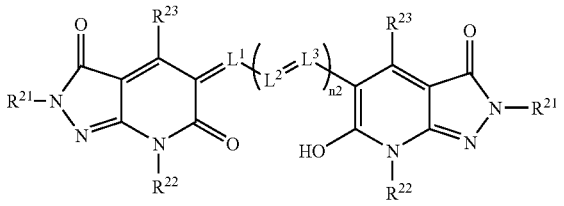

| | $R^{21}$ | $R^{22}$ | $R^{23}$ | $=L^1-(L^2=L^3)_{n2}-$ |
|---|---|---|---|---|
| IV-42 | 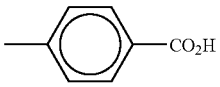 | —H | $—C_2H_5$ | =CH—CH=CH— |
| IV-43 | 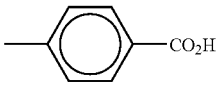 | $—CH_2CH_2OCH_3$ | $—CH_3$ | 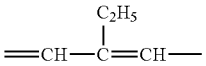 |
| IV-44 | 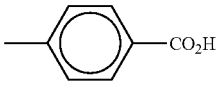 | —H | $—CH_3$ | 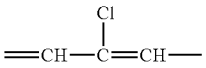 |
| IV-45 | 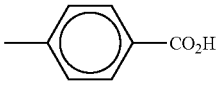 | —H | $—CO_2H$ | 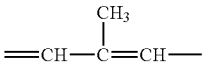 |
| IV-46 | 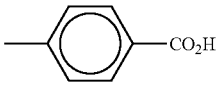 | —H | $—CO_2H$ | 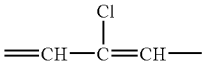 |
| IV-47 | $—CH_2CH_2CN$ | 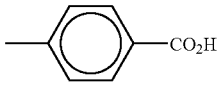 | $—CH_3$ | =CH—CH=CH— |
| IV-48 | $—CH_2CH_2CN$ | 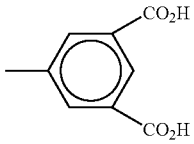 | $—CH_3$ | =CH—CH=CH— |
| IV-49 | 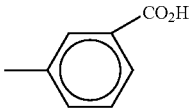 | —H | $—CH_3$ | =CH—CH=CH— |
| IV-50 | 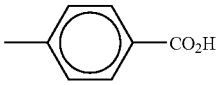 | —H | $—CH_3$ | =CH—CH=CH—CH=CH— |
| IV-51 | $—CH_3$ | 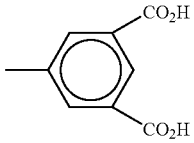 | $—CH_3$ | =CH—CH=CH—CH=CH— |

The dyes for use in the present invention may be synthesized by or according to the methods described in WO88/04794, European Patent Applications Laid-open No. 274,723A1, No. 276,566, and No. 299,435, JP-A-52-92716, JP-A-55-155350, JP-A-55-155351, JP-A-61-205934, JP-A-48-68623, U.S. Pat. Nos. 2,527,583, No. 3,486,897, No. 3,746,539, No. 3,933,798, No. 4,130,429 and No. 4,040,841, JP-A-3-282244, JP-A-3-7931, JP-A-3-167546, and the like.

The solid fine-particle dispersion of the dye for used in the present invention may be prepared by known methods. Details of the production methods are described in "Kinousei-Ganryo Oyogijutsu (Functional Pigment Applied Technologies)" (published by CMC, 1991) and the like.

Dispersion using media is one of general methods. In this method, a dye powder or a dye wetted by water or an organic solvent (so-called wet cake) is made into an aqueous slurry, and the resulting slurry is mechanically crushed in the presence of a dispersing medium (e.g., steel balls, ceramic balls, glass beads, alumina beads, zirconia silicate beads, zirconia beads or Ottawa sand) with a known crusher (e.g., ball mill, vibrating ball mill, planetary ball mill, vertical type sand mill, roller mill, pin mill, coball mill, caddy mill, horizontal sand mill, attritor, or the like). Among these, the average diameter of beads to be used is preferably 2 mm to 0.3 mm, more preferably 1 mm to 0.3 mm, and still more preferably 0.5 mm to 0.3 mm. In addition to the above methods, methods of crushing using a jet mill, roll mill, homogenizer, colloid mill or dissolver, or crushing methods using a ultrasonic dispersion machine may be used.

Also, a method in which a dye is dissolved in a uniform solution and thereafter a poor solvent is added to the solution to precipitate solid fine particles, as disclosed in U.S. Pat. No. 2,870,012, or a method in which a dye is dissolved in an alkaline solution and thereafter the pH of the solution is dropped to precipitate solid fine particles, as disclosed in JP-A-3-182743, may be used.

When the solid fine-particle dispersion is prepared, a dispersing aid is preferably made to be present. Details of the dispersing aids (e.g., concrete explanations, limitations of preferable ranges, exemplified compounds, and the like) that can be preferably used are described in JP-A-2003-172984, from page 33, column 63, line 25 to page 34, column 65, line 25 (Paragraph Nos. 0125 to 0131), and the corresponding part of the publication is incorporated herein as a part of the present specification.

In the present invention, the amount of the above dispersing aid to be used is preferably 0.05 to 0.5, and more preferably 0.1 to 0.3, in terms of mass ratio to the dye for used in the present invention. It is preferable to have the amount of the dispersing aid to be used in the above range, in view of improving the uniformity of the applied surface.

Also, at the time of preparation of the solid fine-particle dispersion, a polyvinyl alcohol, polyvinylpyrrolidone, polyethylene glycol, polysaccharides, or hydrophilic colloid, such as a gelatin, may coexist for the purpose of stabilizing the dispersion and decreasing the viscosity of the dispersion. In the present invention, it is particularly preferable to allow the compound of the formula (VI) explained later to coexist.

The solid fine-particle dispersion of the dye, which is used in the present invention, is preferably those treated under heat before, during, or after dispersion, by such a method as described in JP-A-5-216166, in order to obtain the advantageous effects of the present invention. In the present invention, examples of the heat treatment method that is preferably applicable to the dye dispersion, include a method in which the heat treatment is performed prior to a step of micro-dispersing solid-wise, for example, by heating a dye powder in a solvent; a method in which a dye is dispersed without cooling the dye or with heating the dye, when the dye is dispersed in water or other solvents, in the presence of a dispersant; and a method in which a solution after dispersion of the dye or an coating solution is treated under heat. It is particularly preferable to carry out the heat treatment after the dye is dispersed.

When two or more kinds of the solid fine-particle dispersion containing the dye represented by formula (I) are used in a specific layer, at least one dispersion may be heat-treated.

The pH in heat treatment during or after dispersion of the dye may be in a range required for the dispersion to exist stably, and it is preferably in a range of 2.0 to 8.0, more preferably 2.0 to 6.5, and still more preferably 2.5 or more but less than 4.5. The pH during heat treatment that is in the above range is preferable, in view of an improvement in the film strength of the coating material. For the adjustment of the pH of the dispersion, for example, sulfuric acid, hydrochloric acid, acetic acid, citric acid, phosphoric acid, oxalic acid, carbonic acid, sodium bicarbonate, sodium carbonate, sodium hydroxide, potassium hydroxide or a buffer comprising thereof may be used.

The temperature in the above heat treatment may be arbitrary selected, as far as it is in a range that is 40° C. or higher and is a temperature at which the dye is not decomposed, although it can not be determined in a wholesale manner because it differs depending upon the step at which heat treatment is conducted, the size and shape of a powder or particle, heat treating conditions, the type of solvent, and the like. In the case of heat-treating a powder, an appropriate temperature is generally 40 to 200° C., and preferably 50 to 150° C. In the case of heat-treating in a solvent, an appropriate temperature is generally 40 to 150° C., and preferably 50 to 150° C. In the case of heat-treating during dispersion, an appropriate temperature is generally 40 to 90° C., and preferably 50 to 90° C. In the case of heat-treating the dispersion after a dispersing step is finished, an appropriate temperature is generally 40 to 100° C., preferably 50 to 95° C. When the temperature at heat treatment is too low, only an impreferable poor effect is obtained.

When the heat-treatment is carried out in a solvent, there is no limitation to the type of solvent as far as it does not substantially dissolve the dye. Examples of the solvent include water, alcohols (e.g., methanol, ethanol, isopropyl alcohol, butanol, isoamyl alcohol, octanol, ethylene glycol, diethylene glycol, and ethyl cellosolve), ketones (e.g., acetone, and methyl ethyl ketone), esters (e.g., ethyl acetate and butyl acetate), alkylcarboxylic acids (e.g., acetic acid and propionic acid), nitriles (e.g., acetonitrile), ethers (e.g., dimethoxyethane, dioxane and tetrahydrofuran), amides (e.g., dimethylformamide), and the like.

Even if a solvent dissolves the dye when it is used singly, such a solvent can be used if the dye is not substantially dissolved to a solution obtained by mixing the solvent with water or other solvents, or by adjusting the pH.

The time required for heat treatment also can not be determined in a wholesale manner. When the temperature is low, a long time is required, whereas when the temperature is high, only a short time is required. The heat-treating time can be determined arbitrary as far as the heat treatment is conducted within the range free from an adverse effect on the production process, and the heat-treating time is preferably one hour to 4 days in general.

The fine particles prepared in this manner are dispersed in an appropriate binder to prepare a solid dispersion of almost uniform particles, and then the dispersion is applied to a desired support, to form a layer containing the fine particles of the dye on the photographic light-sensitive material.

As the above binder, a gelatin, or a synthetic polymer, such as a polyvinyl alcohol or polyacryl amide, is usually used, although no particular limitation is imposed on the binder as far as it is a hydrophilic colloid, which can be used for light-sensitive emulsion layers or non-light-sensitive (light-insensitive) layers.

The fine particles in the solid dispersion have an average particle diameter of preferably 0.005 to 10 μm, more preferably 0.01 to 1 μm, and more preferably 0.01 to 0.7 μm. The particle diameter falling in this range is preferable in view of resistance to coagulation of the fine particles and of light-absorbing efficiency. The solid fine-particle dispersion of the dye represented by formula (I) for use in the present invention may be used singly or in combination with a plurality of solid fine-particle dispersions.

Moreover, the number of hydrophilic colloidal layers to which the solid fine particle is to be added may be either one or plural. Examples include a case where a single solid fine-particle dispersion is added to only one layer, a case where a single solid fine-particle dispersion is added to plural layers in lots, a case where plural solid fine-particle dispersions are added to only one layer simultaneously, and a case where plural solid fine-particle dispersions are respectively added to separate layers. These cases, however, are not intended to be limiting of the present invention.

Further, the solid fine-particle dispersion may be incorporated as an anti-halation layer in a necessary amount and further added to a light-sensitive silver halide emulsion layer in a necessary amount for the prevention of irradiation.

The hydrophilic colloidal layer containing the solid fine-particle dispersion of the dye represented by formula (I), which is used in the present invention, is preferably disposed between the support and a silver halide emulsion layer closest to the support. A non-light-sensitive hydrophilic colloidal layer other than the hydrophilic colloidal layer containing the solid fine-particle dispersion may be disposed between the support and a silver halide emulsion layer closest to the support.

The solid fine-particle dispersion of the dye for used in the present invention is contained in a non-light-sensitive hydrophilic colloidal layer according to the hue of the dye, in the silver halide photographic light-sensitive material. In a light-sensitive material according to an embodiment provided with a plurality of non-light-sensitive layers, the solid fine-particle dispersion may be added to the plurality of layers.

The concentration of the dye in the above solid fine-particle dispersion for used in the present invention is generally 0.1 to 50 mass %, and preferably 2 to 30 mass %. The concentration of the dye that falls in the above range is preferable, in view of the viscosity of the dispersion. Further, the amount of the solid fine-particle dye to be applied is preferably about 0.05 to 0.5 g/m$^2$.

In the present invention, a compound represented by the following formula (VI) is preferably contained together with the above solid fine-particle dispersion, in the same photographic constitutional layer.

$$P—((S)_{m3}—R)_{n3} \qquad \text{Formula (VI)}$$

In formula (VI), R represents a hydrogen atom, a hydrophobic group or a hydrophobic polymer; P represents a polymer containing at least one of the following units A, B and C, and having a polymerization degree of 10 or more and 3500 or less; n3 denotes 1 or 2; and m3 denotes 1 or 0;

A:

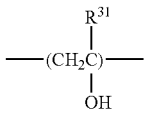

B:

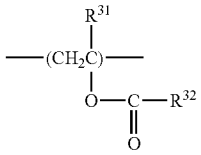

-continued

C:

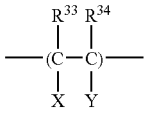

wherein $R^{31}$ represents —H or an alkyl group having 1 to 6 carbon atoms; $R^{32}$ represents —H or an alkyl group having 1 to 10 carbon atoms; $R^{33}$ represents —H or —$CH_3$; $R^{34}$ represents H, —$CH_3$, —$CH_2COOH$ (including an ammonium salt or a metal salt) or —CN; X represents —H, —COOH (including an ammonium salt or a metal salt) or —$CONH_2$; and Y represents —COOH (including an ammonium salt or a metal salt), —$SO_3H$ (including an ammonium salt or a metal salt), —$OSO_3H$ (including an ammonium salt or a metal salt), —$CH_2SO_3H$ (including an ammonium salt or a metal salt), —$CONHC(CH_3)_2CH_2SO_3H$ (including an ammonium salt or a metal salt) or —$CONHCH_2CH_2CH_2N^+(CH_3)_3Cl^-$.

Details of the compound represented by formula (VI) that can be preferably used in the present invention (e.g., concrete explanations, limitations of preferable ranges, exemplified compounds, amount to be used, and synthetic methods) are described in JP-A-11-95371, from page 24, column 46, line 27 to page 33, column 63, line 2 (Paragraph Nos. 0090 to 0128), and the corresponding part of the publication is incorporated herein as a part of the present specification.

Next, the compound represented by formula (A) for use in the present invention will be explained in detail.

Formula (A)

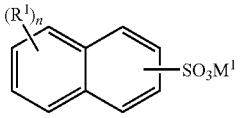

In formula (A), $R^1$ represents a substituted or unsubstituted alkyl or alkoxy group, $M^1$ represents a cation, and n represents an integer of 1 to 7. When n is 2 to more, plural $R^1$'s may be the same or different.

The alkyl group represented by $R^1$ is preferably a substituted or unsubstituted alkyl group having 1 to 6 carbon atoms. The alkoxy group represented by $R^1$ is preferably a substituted or unsubstituted alkoxy group having 1 to 6 carbon atoms. When the alkyl or alkoxy group is substituted with a substituent, preferred examples of the substituent include a fluorine atom, a chlorine atom, an alkyl group, an alkoxy group and an alkylamino group. When $R^1$ is substituted with an alkyl, alkoxy or alkylamino group, the total number of carbon atoms in the substituted $R^1$ is preferably from 1 to 6. In the present invention, $R^1$ is preferably an alkyl group, more preferably an unsubstituted alkyl group.

Preferred examples of the cation represented by $M^1$ include alkali metal ions (e.g., lithium ion, sodium ion, potassium ion), alkaline earth metal ions (e.g., barium ion, calcium ion), and an ammonium ion. Of these, lithium ion, sodium ion, potassium ion and ammonium ion are particularly preferred.

Specific examples of the compounds represented by formula (A) for use in the present invention are shown below, which, however, are not intended to be limiting of the present invention.

(A-1)

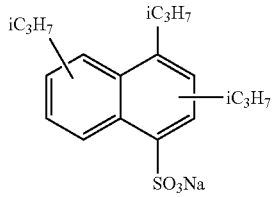

(A-4)

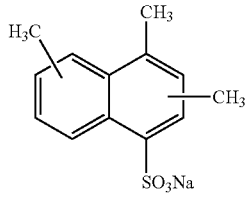

(A-2)

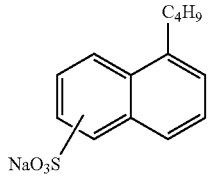

(A-5)

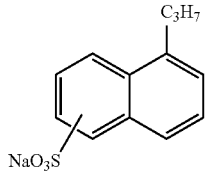

(A-3)

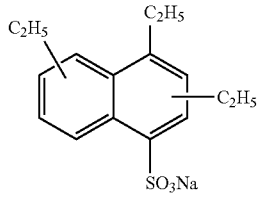

Next, the compound (anionic surfactant) represented by formula (B) for use in the present invention will be explained in detail.

Formula (B)

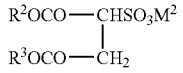

In formula (B), $R^2$ and $R^3$ each independently represent a substituted or unsubstituted alkyl group, and $M^2$ represents a cation.

The alkyl group represented by $R^2$ or $R^3$ is preferably a substituted or unsubstituted alkyl group having 1 to 12 carbon atoms. $R^2$ and $R^3$ may be the same or different. When $R^2$ or $R^3$ has a substituent, preferred examples of the substituent are the same as those of $R^1$ in formula (A).

Preferred examples of the cation represented by $M^2$ include alkali metal ions (e.g., lithium ion, sodium ion, potassium ion), alkaline earth metal ions (e.g., barium ion, calcium ion), and an ammonium ion. Of these, lithium ion, sodium ion, potassium ion and ammonium ion are particularly preferred.

Specific examples of the compounds represented by formula (B) for use in the present invention are shown below, which, however, are not intended to be limiting of the present invention.

(B-1)

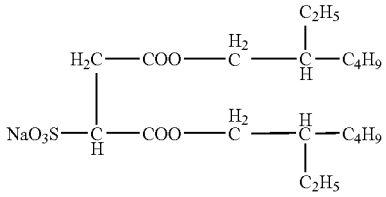

(B-2)

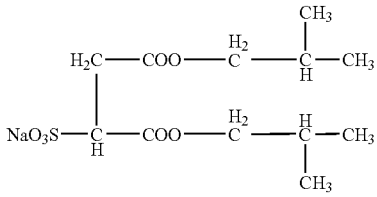

(B-3)

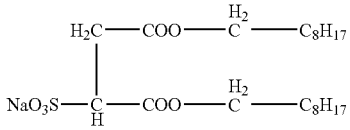

(B-4)

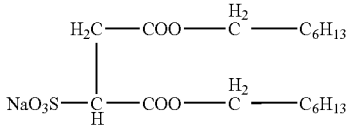

(B-5)

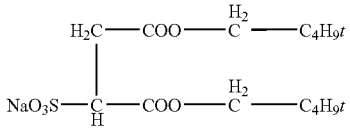

Next, the compound represented by formula (C) will be explained in detail.

Formula (C)

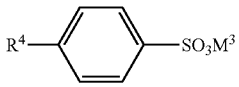

In formula (C), $R^4$ represents a substituted or unsubstituted alkyl group, and $M^3$ represents a cation.

Examples of the alkyl group represented by $R^4$ include alkyl group having 6 to 20 carbon atoms. Examples of the cation represented by $M^3$ include alkali metal ions (e.g., lithium ion, sodium ion, potassium ion), alkaline earth metal ions (e.g., barium ion, calcium ion), and an ammonium ion. Specific examples of the cation represented by $M^3$ include lithium ion, sodium ion, potassium ion and ammonium ion.

Examples of the compound represented by formula (C) include sodium p-hexylbenzenesulfonate, potassium p-octylbenzenesulfonate, sodium p-dodecylbenzenesulfonate, and sodium p-tridecylbenzenesulfonate.

Next, the compound represented by formula (FS) will be explained in detail.

Formula (FS)

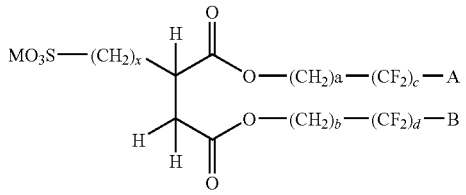

In formula (FS), A and B each independently represent a fluorine atom or a hydrogen atom, a and b each independently represent an integer of from 1 to 6, c and d each independently represent an integer of from 4 to 8; x represents 0 or 1, and M represents a cation.

In formula (FS), A and B each independently represent a fluorine atom or a hydrogen atom, and A and B may be the same or different. It is preferable that both of A and B are fluorine atoms or hydrogen atoms, and it is more preferably that both of A and B are fluorine atoms.

a and b each independently represent an integer of 1 to 6, and a and b may be the same or different as long as a and b are each an integer of 1 to 6. It is preferable that a and b each are an integer of from 1 to 6, and that a=b; more preferable that a and b each are an integer of 2 or 3, and that a=b; and further preferable that a and b are each an integer of 2.

c and d each independently represent an integer of from 4 to 8, and c and d may be the same or different as long as c and d are each an integer of 4 to 8. It is preferable that c and d each are an integer of from 4 to 6, and that c=d; more preferable that c and d each are an integer of 4 or 6, and that c=d; and further preferable that c and d are each an integer of 4.

x represents 0 or 1. With respect to x, 0 and 1 are equally preferred.

M represents a cation. Suitable examples of the cation represented by M include alkali metal ions (such as lithium ion, sodium ion and potassium ion), alkaline earth metal ions (such as barium ion and calcium ion) and ammonium ion. Of these, lithium ion, sodium ion, potassium ion and ammonium ion are preferred over the others.

Of the compounds represented by formula (FS), compounds represented by formula (FS-a) are preferred.

Formula (FS-a)

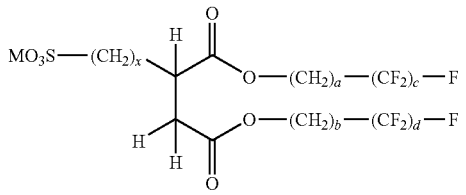

In formula (FS-a), a, b, c, d, M and x have the same meanings as those in formula (FS), respectively, and preferable ranges thereof are also the same.

Of the compounds represented by formula (FS), compounds represented by formula (FS-b) are more preferred.

Formula (FS-b)

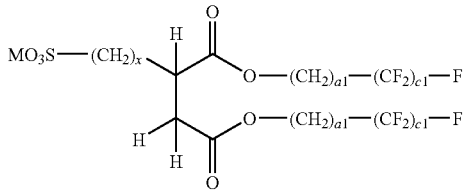

In formula (FS-b), a1 represents an integer of from 2 to 3; c1 represents an integer of from 4 to 6; M represents a cation; and x represents 0 or 1.

In formula (FS-b), a1 is preferably an integer of 2. c1 is preferably an integer of 4. With respect to x, 0 and 1 are equally preferred.

Specific examples of the compound (surfactant) that can be preferably used in the present invention are shown below, which, however, are not intended to be limiting of the present invention.

FS-1

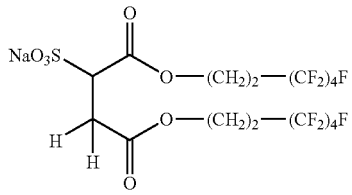

FS-2

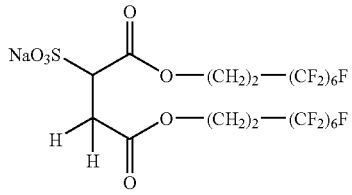

FS-3

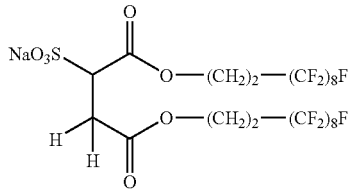

FS-4

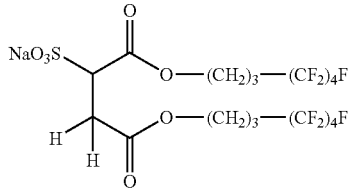

FS-5

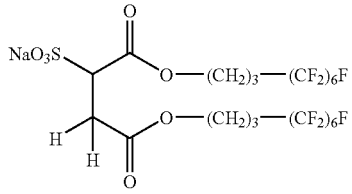

-continued
FS-6
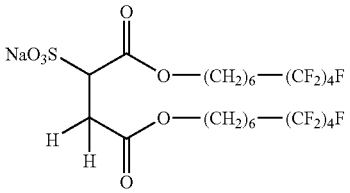
FS-7
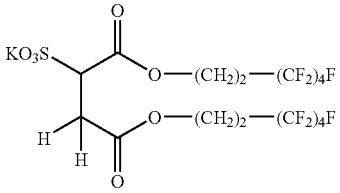
FS-8
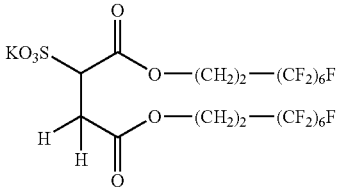
FS-9
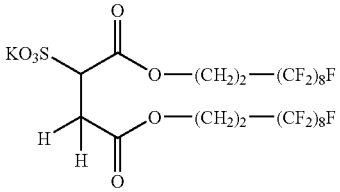
FS-10
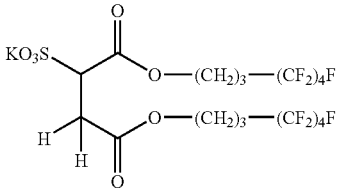
FS-11
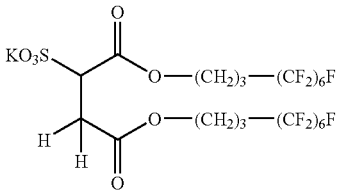
FS-12
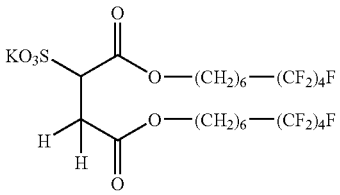
FS-13
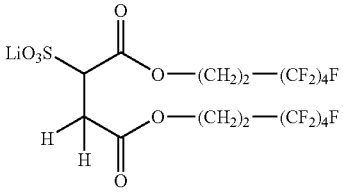
-continued
FS-14
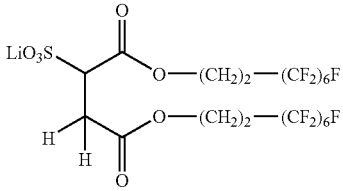
FS-15
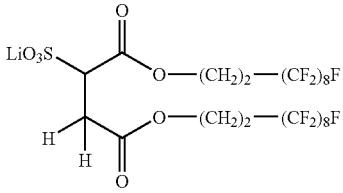
FS-16
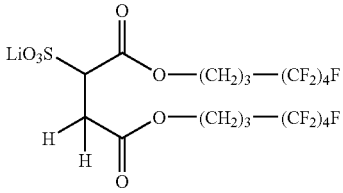
FS-17
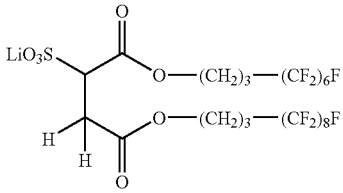
FS-18
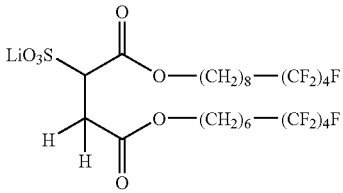
FS-19
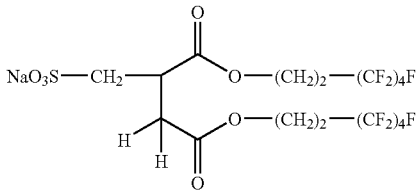
FS-20
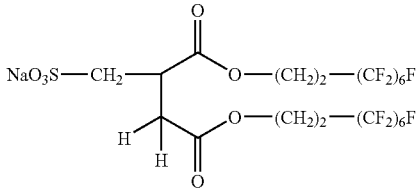
FS-21
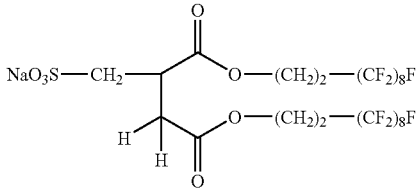

-continued

FS-22

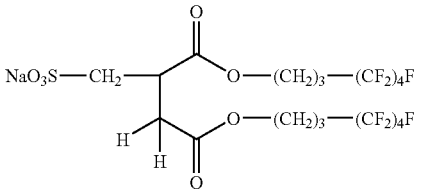

FS-23

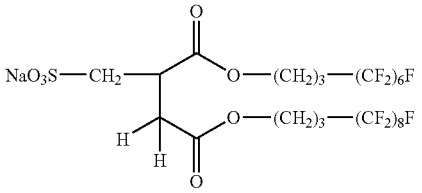

FS-24

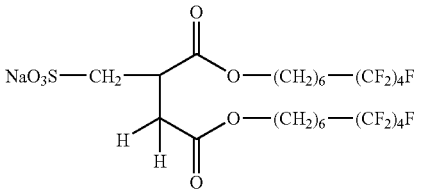

FS-25

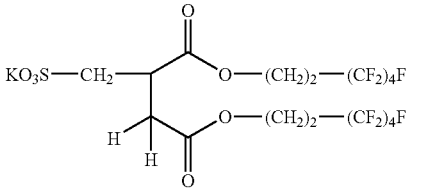

FS-26

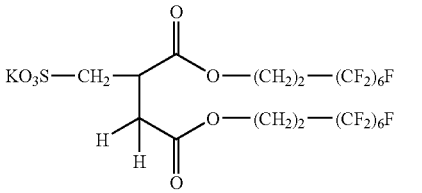

FS-27

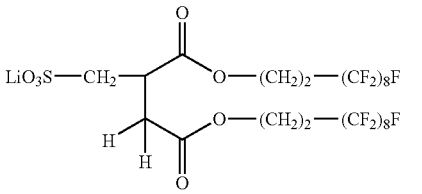

FS-28

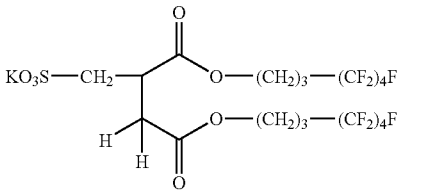

FS-29

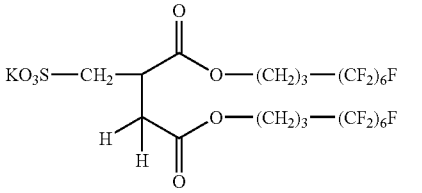

-continued

FS-30

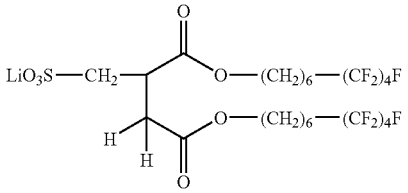

FS-31

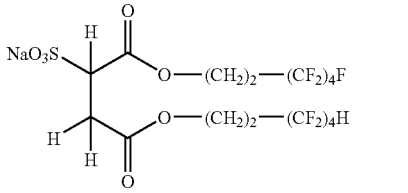

FS-32

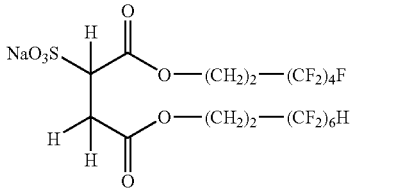

In the present invention, in the case where the above-mentioned surfactant is used in a layer of the photographic light-sensitive material, an aqueous coating composition containing the surfactants may consist of the surfactants for used in the present invention and water, or may contain another component as needed depending on the purpose.

In the above-mentioned aqueous coating composition, each of the surfactant for used in the present invention may be used singly, or as a mixture of two or more thereof. Moreover, a surfactant other than the surfactant for used in the present invention may be used in combination with the above-mentioned surfactants for used in the present invention. The surfactant which can be combined with the above-mentioned surfactants for used in the present invention includes various surfactants such as anionic-, cationic-, and nonionic surfactants, and may be a polymeric surfactant. Among those, an anionic- or nonionic surfactant is more preferred. Examples of the surfactant which can be combined with the above-mentioned surfactants for used in the present invention, include those described in, for example, JP-A-62-215272 (pages 649-706), Research Disclosure (RD) Items 17643, pages 26-27 (December, 1978), RD Item 18716, page 650 (November, 1979) and RD Item 307105, pages 875-876 (November, 1989).

A representative example of the materials which may be contained in the above-mentioned aqueous coating composition is a polymeric compound. The polymeric compound may be an aqueous medium-soluble polymer, or may be a polymer dispersion in water (that is, a polymeric latex). The soluble polymer is not particularly limited, and includes, for example, gelatin, a polyvinyl alcohol, casein, agar, acacia gum, hydroxyethylcellulose, methylcellulose, and carboxymethylcellolose. The polymeric latex includes dispersions of: homo- or copolymers of various vinyl monomers (for example, acrylate derivatives, methacrylate derivatives, acrylamide derivatives, methacrylamide derivatives, styrene derivatives, conjugate diene derivatives, N-vinyl compounds, O-vinyl compounds, vinyl nitrile, and other vinyl compounds (such as ethylene, and vinylidene chloride)); or condensation-series polymers (for example, polyesters, polyurethanes, polycarbonates, polyamides). Detailed examples for such polymeric compounds can include, for example, those described in JP-A-62-215272 (pp. 707-763), and Research Disclosure (RD) Item 17643, p. 651 (December, 1978), RD Item 18716, p. 650 (November, 1979), and RD Item 307105, pp. 873-874 (November, 1989).

The medium for the above-mentioned aqueous coating composition may be water alone, or a mixed solvent of an organic solvent other than water (for example, methanol, ethanol, isopropyl alcohol, n-butanol, methyl cellosolve, dimethylformamide, acetone) and water. The proportion of water in the medium for the aqueous coating composition is preferably 50 mass % or more.

The above-mentioned aqueous coating composition may contain various compounds depending on the layer of the photographic light-sensitive material in which the aqueous coating composition is used. Such compounds may be dissolved or dispersed in a medium. Examples thereof include various couplers, ultraviolet absorbents, anti-color mixing agents, antistatic agents, scavengers, antifog agents, hardening agents, dyes, and fungicides. To obtain effective antistatic ability and uniformity of coating when used in the photographic light-sensitive material, they are preferably used in the uppermost hydrophilic colloidal layer.

In this case, the coating composition may contain other surfactants, matting agents, lubricants, colloidal silica, gelatin plasticizers and so forth, besides the hydrophilic colloid (e.g., gelatin) and the surfactants for used in the present invention.

The amount of the compound (surfactant) represented by formula (A), (B), (FS), (FS-a) or (FS-b) to be used is not particularly limited, and the use amount may be varied optionally depending on the structure and application of the surfactant, the kind and amount of a compound contained in the aqueous composition, the constitution of the medium, and the like. For example, in the case where the surfactants used in the present invention is used in a coating solution for the uppermost hydrophilic colloid (gelatin) layer for the photographic light-sensitive material that is one preferred embodiment of the present invention, the use amount is preferably 0.003 to 2.0 mass % in terms of the concentration (mass %) in the coating solution, and it is preferably 0.03 to 10 mass % based on the gelatin solid content.

The following will describe a photographic layer of the silver halide color photographic light-sensitive material for being projected for cinema, and so forth, of the present invention.

The silver halide color photographic light-sensitive material of the present invention is a silver halide color photographic light-sensitive material having a transmission-type support and at least one light-sensitive layer, on the transmission-type support, composed of plural silver halide emulsion layers substantially different from each other in color sensitivity. The present invention can be preferably applied to color photographic light-sensitive materials for ordinary use or movies, such as color positive films and positive films for cinema. The present invention is particularly preferably applied to the color positive light-sensitive materials for cinema.

In the present invention, the number and the arranging order of layers of each of light-sensitive silver halide emulsion layers and non-light-sensitive hydrophilic colloidal layer(s) are not particularly limited. Each of the yellow—, cyan- and magenta-color-forming light-sensitive silver halide emulsion layers may be made of a single light-sensitive silver halide emulsion layer or plural silver halide emulsion layers which have the same color sensitivity but have different sensitivities.

The relationship between the color formation efficiency and the color sensitivity of each of the color-forming light-sensitive silver halide emulsion layers is not limited, either. For example, a certain layer out of the color-forming light-sensitive silver halide emulsion layers may have color sensitivity in the infrared region.

In the present invention, a typical example of the arranging order of the layers is, in increasing order of distance from the support, a non-light-sensitive hydrophilic colloidal layer containing a dispersion of solid fine particles of dye and/or black colloidal silver, a yellow-color-forming light-sensitive silver halide emulsion layer, a non-light-sensitive hydrophilic colloidal layer (color-mixing-preventing layer), a cyan-color-forming light-sensitive silver halide emulsion layer, a non-light-sensitive hydrophilic colloidal layer (color-mixing-preventing layer), a magenta-color-forming light-sensitive silver halide emulsion layer, and a non-light-sensitive hydrophilic colloidal layer (protective layer). Depending on the intended purposes, however, changes may be made in the above-mentioned arranging orders, or in the number of light-sensitive silver halide emulsion layers or non-light-sensitive hydrophilic colloidal layers.

In the silver halide color photographic light-sensitive material of the present invention, Fe is brought mainly from gelatin, dyes, and emulsion grains intentionally doped with Fe. The Fe content in the present invention, is preferably $2\times10^{-5}$ mol/m$^2$ or below (preferably from $1\times10^{-8}$ to $2\times10^{-5}$ mol/m$^2$), more preferably $8\times10^{-6}$ mol/m$^2$ or below (preferably from $1\times10^{-8}$ to $8\times10^{-6}$ mol/m$^2$), and most preferably $3\times10^{-6}$ mol/m$^2$ or below (preferably from $1\times10^{-8}$ to $3\times10^{-6}$ mol/m$^2$).

In the present invention, gelatin is preferably used as hydrophilic colloid. Other hydrophilic colloids also can be used in arbitrary proportions as substitutes for gelatin, if needed. Use can be made of, for example, a gelatin derivative, a graft polymer of gelatin with another polymer, a protein, such as albumin and casein; a cellulose derivative, such as hydroxyethyl cellulose, carboxymethyl cellulose, and cellulose sulfates; saccharides, such as sodium alginate and a starch derivative; and many synthetic polymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole.

The silver halide grains for use in the present invention includes silver chloride, silver bromide, silver (iodo)chlorobromide, silver iodobromide, and the like. Particularly, in the present invention, in view of reducing development processing time, it is preferable to use silver chloride, silver chlorobromide, silver chloroiodide, or silver chloroiodobromide, each having silver chloride content of 95 mol % or more. The silver halide grains in the emulsion may be those comprising regular crystals having, for example, a cubic, octahedron, or tetradecahedron form, those comprising irregular crystals having, for example, a spherical or plate form, those having crystal defects such as a twin plane, or complex systems of these crystals. Also, use of a tabular grain having a (111) plane or a (100) plane as its principal plane, is preferable in view of achieving rapid color development processing and decreasing color contamination in the processing. The tabular high-silver-chloride emulsion grains having a (111) plane or a (100) plane as its principal plane may be prepared by the methods disclosed in JP-A-6-138619, U.S. Pat. Nos. 4,399,215, No. 5,061,617, No. 5,320,938, No. 5,264,337, No. 5,292,632, No. 5,314,798, and No. 5,413,904, WO94/22051, and the like.

As a silver halide emulsion which can be used in combination with the above emulsions, in the present invention, any silver halide emulsion having an arbitrary halogen composition may be used. However, in view of rapid processability, silver (iodo)chloride and silver chloro(iodo)bromide, each having 95 mol % or more of silver chloride are preferable, and further, a silver halide emulsion having 98 mol % or more of silver chloride is preferable.

In the present invention, silver halide grain in the photographic emulsion may be one having a regular crystal form such as a cubic, octahedron or tetradecahedron form; one having crystal defects such as a twin plane, or complex system thereof. As to the grain diameter of the silver halide, either fine grains having a grain diameter of about 0.2 μm or less, or large-size grains whose projected-area-equivalent diameter is up to about 10 μm, may be adopted, and further it may be polydisperse or monodisperse. The silver halide grains for use in the present invention are preferably monodisperse for the purpose of accelerating the development progress. A coefficient of variation in the grain size of each silver halide grain is preferably 0.3 or less (more preferably 0.3 to 0.05) and more preferably 0.25 or less (more preferably 0.25 to 0.05). The coefficient of variation so-called here is expressed by the ratio (s/d) of the statistical standard deviation (s) to the average grain size (d).

The silver halide photographic emulsions that can be used in the present invention may be prepared, for example, by the methods described in Research Disclosure (hereinafter abbreviated to as RD) No. 17643 (December 1978), pp. 22-23, "I. Emulsion preparation and types", and ibid. No. 18716 (November 1979), p. 648, and ibid. No. 307105 (November, 1989), pp. 863-865; the methods described by P. Glafkides, in Chemie et Phisique Photographique, Paul Montel (1967); by G. F. Duffin, in Photographic Emulsion Chemistry, Focal Press (1966); and by V. L. Zelikman et al., in Making and Coating of Photographic Emulsion, Focal Press (1964).

Monodispersed emulsions described in U.S. Pat. Nos. 3,574,628, and No. 3,655,394, and U.K. Patent No. 1,413,748 are also preferable. Tabular grains having an aspect ratio of about 3 or more can also be used in the present invention. Such tabular grains may be prepared easily, according to the methods described by Gutoff, in Photographic Science and Engineering, Vol. 14, pp. 248-257 (1970); U.S. Pat. Nos. 4,434,226, No. 4,414,310, No. 4,433,048, and No. 4,439,520, and U.K. Patent No. 2,112,157.

As to the crystal structure in the present invention, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion can be any one of a surface latent image-type that forms a latent image primarily on the grain surface, an internal latent image-type that forms a latent image inside the grain, and another type of emulsion that forms a latent image both on the surface and inside the grain; but it must be a negative type emulsion in any case. Among the internal latent image-type emulsions, an emulsion of a core/shell type internal latent image-type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development process or the like.

As the silver halide emulsion, generally, those subjected to physical ripening, chemical ripening, and spectral sensitization are used. Additives to be used in these steps are described in RD Nos. 17643, 18716, and 307105. Their relevant parts are listed in a table described later.

In the light-sensitive material of the present invention, two or more types of emulsions differing in at least one feature among the grain size, the distribution of grain size, the halogen composition, the shape of grain and the sensitivity of the light-sensitive silver halide emulsion, may be mixed and used in one layer.

The amount of silver to be applied in the silver halide color photographic light-sensitive material of the present invention, is preferably 6.0 g/m$^2$ or less, more preferably 4.5 g/m$^2$ or less, and particularly preferably 2.0 g/m$^2$ or less. Further, the amount of silver to be applied is generally 0.01 g/m$^2$ or more, preferably 0.02 g/m or more, and more preferably 0.5 g/m$^2$ or more.

In the present invention, a 1-aryl-5-mercaptotetrazole compound, in an amount of preferably $10\times10^{-5}$ to $5.0\times10^{-2}$ mol, and more preferably $1.0\times10^{-4}$ to $1.0\times10^{-2}$ mol, per mol of silver halide, is preferably added to any one layer of the photographic structural layers: the light-sensitive silver halide emulsion layers and non-light-sensitive hydrophilic colloidal layers (intermediate layers and protective layers) disposed on the support; and the compound is preferably added to a silver halide emulsion layer. The addition of this compound in an amount falling in the above range further reduces stains to the surface of a processed color photograph after continuous processing.

As the 1-aryl-5-mercaptotetrazole compound, preferred is one in which the aryl group at the 1-position is an unsubstituted or substituted phenyl group. Preferable specific examples of the substituent include an acylamino group (e.g., acetylamino and —$NHCOC_5H_{11}$(n)), a ureido group (e.g., methylureido), an alkoxy group (e.g., methoxy), a carboxylic acid group, an amino group, and a sulfamoyl group. A plurality of groups (e.g. two to three groups) selected from these groups may be bonded with the phenyl group. Also, the position of the substituent is preferably the meta or para position. Specific examples of the compound include 1-(m-methylureidophenyl)-5-mercaptotetrazole and 1-(m-acetylaminophenyl)-5-mercaptotetrazole.

The photographic additives that can be used in the present invention or can be used in combination with the compound defined in the present invention are described in the following Research Disclosures (RD), whose particular parts are given in the following table.

| | Kind of Additive | RD 17643 | RD 18716 | RD 307105 |
|---|---|---|---|---|
| 1 | Chemical sensitizers | p. 23 | p. 648 (right column) | p. 866 |
| 2 | Sensitivity-enhancing agents | | p. 648 (right column) | |

-continued

| Kind of Additive | RD 17643 | RD 18716 | RD 307105 |
|---|---|---|---|
| 3 Spectral sensitizers and Supersensitizers | pp. 23–24 | pp. 648 (right column)–649 (right column) | pp. 866–868 |
| 4 Brightening agents | p. 24 | pp. 647 (right column) | p. 868 |
| 5 Light absorbers, Filter dyes, and UV Absorbers | pp. 25–26 | pp. 649 (right column)–650 (left column) | p. 873 |
| 6 Binders | p. 26 | p. 651 (left column) | pp. 873–874 |
| 7 Plasticizers and Lubricants | p. 27 | p. 650 (right column) | p. 876 |
| 8 Coating aids and Surfactants | pp. 26–27 (excluding ones represented by formula (C), as defined in the present invention) | p. 650 (right column) (excluding ones represented by formula (C), as defined in the present invention) | pp. 875–876 (excluding ones represented by formula (C), as defined in the present invention) |
| 9 Antistatic agents | p. 27 | p. 650 (right column) | pp. 876–877 |
| 10 Matting agents | | | pp. 878–879 |

In the silver halide color photographic light-sensitive material of the present invention, the following couplers are particularly preferably used, though various dye-forming couplers may be used:

Yellow couplers: couplers represented by the formula (I) or (II) in EP 502,424A; couplers represented by the formula (1) or (2) in EP513,496A (particularly, Y-28 on page 18); couplers represented by the formula (I) in claim 1 in JP-A-5-307248; couplers represented by the formula (I) in U.S. Pat. No. 5,066,576, column 1, line 45 to line 55; couplers represented by the formula (I) in JP-A-4-274425, paragraph No. 0008; couplers described in claim 1 in EP 498,381A1, page 40 (particularly, D-35 on page 18); couplers represented by the formula (Y) in EP 447,969A 1, page 4 (particularly Y-1 (page 17) and Y-54 (page 41)); and couplers represented by any one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A4-73 and -75 (page 139) in EP 456,257; M4 and -6 (page 26) and M-7 (page 27) in EP 486,965; M-45 in JP-A-6-43611, paragraph No. 0024; M-1 in JP-A-5-204106, paragraph No. 0036; and M-22 in JP-A-4-362631, paragraph No. 0237.

Cyan couplers CX-1, 3, 4, 5, 11, 12, 14, and 15 (page 14 to page 16) in JP-A-4-204843; C-7, 10 (page 35), 34, 35 (page 37), (I-1), (I-17) (page 42 to page 43) in JP-A-443345; and couplers represented by the formula (Ia) or (Ib) in claim 1 in JP-A-6-67385.

Polymer couplers: P-1 and P-5 (page 11) in JP-A-2-44345.

As couplers allowing the color developed dye to have moderate diffusibility, those described in U.S. Pat. No. 4,366,237, GB 2,125,570, EP 96,873B and DE 3,234,533 are preferable.

As couplers for compensating unnecessary absorption of a color developed dye, preferred are yellow-colored cyan couplers represented by the formula (CI), (CII), (CIII), or (CIV) described on page 5 in EP 456,257A1 (particularly YC-86, on page 84), yellow-colored magenta couplers ExM-7 (page 202), EX-1 (page 249) and EX-7 (page 251) described in the same EP publication; magenta-colored cyan couplers CC-9 (column 8) and CC-13 (column 10) described in U.S. Pat. No. 4,833,069; (2) (on column 8) of U.S. Pat. No. 4,837,136; and uncolored masking couplers represented by the formula (C-1) described in claim 1 in WO92/11575 (particularly, the exemplified compounds on page 36 to page 45).

As examples of the compound (including a dye-forming coupler) which reacts with an oxidized product of a developing agent to release a photographically useful compound residue, the following compounds are given.

Developing restrainer-releasing compounds: compounds represented by the formula (I), (II), (III), or (IV) described in EP 378,236A1, page 1 (particularly T-101 (page 30), T-104 (page 31), T-113 (page 36), T-131 (page 45), T-144 (page 51) and T-158 (page 58)); compounds represented by the formula (I) in EP 436,938A2, page 7 (particularly, D49 (page 51)); compounds represented by the formula (1) in JP-A-5-307248 (particularly, (23) in paragraph No. 0027)); and compounds represented by the formula (I), (II), or (III) in EP 440,195A2, page 5 to page 6 (particularly, I-(1) on page 29)). Bleaching-accelerator-releasing compounds: compounds represented by the formula (I) or (I') described in EP 310,125A2, page 5 (particularly (60) and (61) on page 61)); and compounds represented by the formula (I) in claim 1 in JP-A-6-59411 (particularly, (7) in paragraph No. 0022). Ligand-releasing compounds: compounds represented by the formula LIG-X described in claim 1 in U.S. Pat. No. 4,555,478 (particularly, compounds described in column 12, line 21 to line 41). Leuco dye-releasing compounds: the compounds 1 to 6 in U.S. Pat. No. 4,749,641, columns 3 to 8. Fluorescent dye-releasing compounds: compounds represented by COUP-DYE in claim 1 in U.S. Pat. No. 4,774,181 (particularly compounds 1 to 11 in columns 7 to 10). Development-accelerator- or fogging-agent-releasing compounds: compounds represented by the formula (1), (2) or (3) in U.S. Pat. No. 4,656,123, column 3 (particularly, (I-22) in column 25) and ExZK-2 in EP 450,637A2, page 75, line 36 to line 38. Compounds releasing a group which becomes a dye for the first time when it is spilt-off: compounds represented by the formula (I) in claim 1 in U.S. Pat. No. 4,857,447 (particularly, Y-1 to Y-19 in columns 25 to 36).

As additives other than the dye-forming couplers, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272. Latex for impregnation with the oil-soluble organic compound: latex described in U.S. Pat. No. 4,199,363. Scavengers for an oxidized product of a developing agent: compounds represented by the formula (I) in U.S. Pat. No. 4,978,606, column 2, line 54 to line 62 (particularly I-(1), (2), (6), (12) (columns 4 to 5)), and compounds represented by the formula in U.S. Pat. No. 4,923,787, column 2, line 5 to line 10 (particularly Compound 1 (column 3). Stain preventive agents: compounds represented by one of the formulae (I) to (III) in EP 298321A, page 4, line 30 to line 33 (particularly, I-47, 72, III-1, 27 (page 24 to page 48)). Anti-fading agents: A-6, 7, 20, 21, 23, 24, 25, 26, 30, 37, 40, 42, 48, 63, 90, 92, 94, and 164 (page 69 to page 118) in EP 298321A, and II-1 to III-23 in U.S. Pat No. 5,122,444, columns 25 to 38 (particularly, III-10); I-1 to III-4 in EP 471347A, page 8 to page 12 (particularly, II-2); and A-1 to 48 in U.S. Pat. No. 5,139,931, columns 32 to 40 (particularly A-39 and 42). Materials reducing the amount of a color development-enhancing agent or a color contamination preventive agent to be used: I-1 to II-15 in EP 411324A, page 5 to page 24 (particularly, I-46). Formalin scavengers: SCV-1 to 28 in EP 477932A, page 24 to page 29 (particularly SCV-8). Hardener: H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to 76) represented by the formula (6) in JP-A-2-214852, page 8, the lower right (particularly, H-14); and compounds described in claim 1 in U.S. Pat. No. 3,325,287. Precursors of developing restrainers: P-24, 37, 39 (page 6 to page 7) in JP-A-62-168139; and compounds described in claim 1 of U.S. Pat. No. 5,019,492 (particularly 28 to 29 in column 7). Antiseptics and mildew-proofing agents: I-1 to III-43 in U.S. Pat. No. 4,923,790, columns 3 to 15 (particularly II-1, 9, 10, and 18 and III-25). Stabilizers and antifoggants: I-1 to (14) in U.S. Pat. No. 4,923,793, columns 6 to 16 (particularly, I-1, 60, (2) and (13)); and compounds 1 to 65 in U.S. Pat. No. 4,952,483, columns 25 to 32 (particularly, 36). Chemical sensitizers: triphenylphosphine selenide; and compound 50 in JP-A-540324. Dyes: a-1 to b-20 in JP-A-3-156450, page 15 to page 18 (particularly, a-1, 12, 18, 27, 35, 36, b-5, and V-1 to 23 on pages 27 to 29, particularly, V-1); F-I-1 to F-II-43 in EP 445627A, page 33 to page 55 (particularly F-I-11 and F-II-8); III-1 to 36 in EP 457153A, page 17 to page 28 (particularly III1 and 3); compounds 1 to 22 in EP319999A, page 6 to page 11 (particularly, compound 1); compounds D-1 to 87 (page 3 to page 28) represented by one of the formulae (1) to (3) in EP 519306A; compounds 1 to 22 (columns 3 to 10) represented by the formula (I) in U.S. Pat. No. 4,268,622; and compounds (1) to (31) (columns 2 to 9) represented by the formula (I) in U.S. Pat. No. 4,923,788. UV absorbers: compounds (18b) to (18r) and 101 to 427 (page 6 to page 9) represented by the formula (1) in JP-A46-3335; compounds (3) to (66) (page 10 to page 44) represented by the formula (I) and compounds HBT-1 to HBT-10 (page 14) represented by the formula (III) in EP 520938A; and compounds (1) to (31) (columns 2 to 9) represented by the formula (I) in EP 521823A.

The silver halide color photographic light-sensitive material of the present invention can preferably contain a compound having a fluorine atom, in a layer situated farthest from the support on the side having emulsion layers, or in a layer situated farthest from the support on the side having no emulsion layer, or both sides. As the compound used therein, the compound represented by formula (FS) defined in the present invention can be preferably used.

In the silver halide color photographic light-sensitive material of the present invention, the sum of the film thicknesses of all hydrophilic colloidal layers on the side provided with emulsion layers is preferably 28 μm or less, more preferably 23 μm or less, still more preferably 18 μm or less, and particularly preferably 16 μm or less. The sum of the film thicknesses is generally 0.1 μm or above, preferably 1 μm or above, more preferably 5 lam or above. The film swelling rate $T_{1/2}$ is preferably 60 seconds or less and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The film-thickness means a film thickness measured at 25° C. and a relative humidity of 55% under controlled humid condition (2 days). $T_{1/2}$ can be measured using a swellometer of the type described by A. Green et al. in Photogr. Sci. Eng., Vol. 19, 2, page 124 to page 129. $T_{1/2}$ can be regulated by adding a hardener to a gelatin as a binder, or by changing the condition for the lapse of time after application.

The rate of swelling is preferably 180 to 280% and more preferably 200 to 250%. Here, the rate of swelling means a standard showing the magnitude of equilibrium swelling when the silver halide photographic light-sensitive material of the present invention is immersed in 27° C. distilled water to swell the material, and it is given by the following equation:

Rate of swelling (unit: %)=(Total film thickness when swelled)/(Total film thickness when dried)×100.

The above rate of swelling can be made to fall in the above range by regulating the amount of a gelatin hardener to be added.

The silver halide color photographic light-sensitive material of the present invention for cinema can be processed through standard processing steps for a positive light-sensitive material for cinema. Conventional standard processing steps for a positive light-sensitive material for cinema (except for a drying process)

(1) Color developing bath
(2) Stop bath
(3) Wash bath
(4) First fixing bath
(5) Wash bath
(6) Bleach-accelerating bath
(7) Bleaching bath
(8) Wash bath
(9) Sound development (coating development)
(10) Wash bath
(11) Second fixing bath
(12) Wash bath
(13) Stabilizing bath In the present invention, when, among the above process steps, color developing time (the above step (1)) is 2 minutes and 30 seconds or less (the lower limit is preferably 6 seconds or more, more preferably 10 seconds or more, further more preferably 20 seconds or more, and most preferably 30 seconds or more), and more preferably 2 minutes or less (the preferable lower limits are as same as those mentioned for the developing time of 2 minutes and 30 seconds or less), the effects of the present invention are remarkable, and therefore such a developing time is preferable.

The support will be hereinafter explained.

In the present invention, as the support, a transparent support is preferable and a plastic film support is more preferable. Examples of the plastic film support include films, for example, of a polyethylene terephthalate, polyethylene naphthalate, cellulose triacetate, cellulose acetate butylate, cellulose acetate propionate, polycarbonate, polystyrene, or polyethylene.

Among these films, polyethylene terephthalate films are preferable and biaxially oriented (stretched) and thermally fixed polyethylene terephthalate films are particularly preferable in view of stability, toughness, and the like.

The thickness of the support is generally 15 to 500 μm, particularly preferably 40 to 200 μm, in view of handling ability and usability for general purposes, and most preferably 85 to 150 μm, though no particular limitation is imposed on the thickness of the above support.

The transmission type support (transparent support) means those through which 90% or more visible light preferably transmits, and the support may contain silicon, alumina sol, chrome salt, or zirconium salt which are made into a dye, to an extent that it does not substantially inhibit the transmission of light.

The following surface treatment is generally carried out on the surface of the plastic film support, to bond light-sensitive layers firmly with the surface. The surface on the side where an antistatic layer (backing layer) is formed is likewise surface-treated in general. Specifically, there are the following two methods:

(1) A method, in which surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment, or ozone oxygen treatment, is carried out, and then a photographic emulsion (coating solution for the formation of a light-sensitive layer) is directly applied, to obtain adhesive force; and (2) A method, in which after the above surface treatment is once carried out, an undercoating layer is formed, and then a photographic emulsion layer is applied onto the undercoating layer.

Among these methods, the method (2) is more effective and hence widely used. These surface treatments each are assumed to have the effects of: forming a polar group in some degree on the surface of the support which is originally hydrophobic, removing a thin layer which gives an adverse effect on the adhesion of the surface, and increasing the crosslinking density of the surface, thereby increasing the adhesive force. As a result, it is assumed that, for example, the affinity of components contained in a solution of the undercoating layer to the polar group is increased and the fastness of the adhering surface is increased, thereby improving adhesion between the undercoating layer and the surface of the support.

It is preferable that a non-light-sensitive layer containing conductive metal oxide particles be formed, on the surface of the above plastic film support on the side provided with no light-sensitive layers. As the binder for the above non-light-sensitive layer, an acrylic resin, vinyl resin, polyurethane resin, or polyester resin is preferably used. This non-light-sensitive layer is preferably film-hardened. As the hardener, an aziridine-series, triazine-series, vinylsulfone-series, aldehyde-series, cyanoacrylate-series, peptide-series, epoxy-series, or melamine-series compound, or the like is used. Among these, a melamine-series compound is particularly preferable with the view of fixing the conductive metal oxide particles firmly.

Examples of materials used for the conductive metal oxide particles may include ZnO, $TiO_2$, $SnO_2$, $Al_2O_3$, $In_2O_3$, MgO, BaO, $MoO_3$, and $V_2O_5$, composite oxides of these oxides, and metal oxides obtained by adding a different type of atom to each of these metal oxides.

As the metal oxide, $SnO_2$, ZnO, $Al_2O_3$, $TiO_2$, $In_2O_3$, MgO, and $V_2O_5$ are preferable; $SnO_2$, ZnO, $In_2O_3$, $TiO_2$ and $V_2O_5$ are more preferable; and $SnO_2$ and $V_2O_5$ are most preferable.

Examples of the metal oxide containing a small amount of a different type of atom may include those obtained by doping each of these metal oxides with generally 0.01 to 30 mol % (preferably 0.1 to 10 mol %) of a different element, specifically, by doping ZnO with Al or In, $TiO_2$ with Nb or Ta, $In_2O_3$ with Sn, or $SnO_2$ with Sb, Nb, or a halogen atom. When the amount of the different type of element to be added is too small, only insufficient conductivity can be imparted to the oxide or the composite oxide, whereas when the amount is too large, the blackening of the particle is increased, leading to the formation of a blackish antistatic layer. This shows that the oxides containing a different type of element in the amount out of the above range are unsuitable for the light-sensitive material. Therefore, as materials of the conductive metal oxide particle, metal oxides or composite metal oxides containing a small amount of a different type of element are preferable. Those having an oxygen defect in their respective crystal structure are also preferable.

The conductive metal oxide particles generally have a ratio by volume of 50% or less to the non-light-sensitive layer as a whole, and preferably 3 to 30%. The amount of the conductive metal oxide particles to be applied preferably follows the condition described in JP-A-10-62905. When the volume ratio is too large, the surface of the processed color photograph is easily contaminated, whereas when the ratio is too small, the antistatic function is insufficiently performed.

It is more preferable that the particle diameter of the conductive metal oxide particle be as small as possible, to decrease light scattering. However, it must be determined based on, as a parameter, the ratio of the refractive index of the particle to that of the binder, and it can be determined using the Mie's theory. The average particle diameter is generally 0.001 to 0.5 lam and preferably 0.003 to 0.2 μm. The average particle diameter so-called here is a value including not only a primary particle diameter but also a particle diameter of higher-order structure of the conductive metal oxide particles.

When the fine particle of the aforementioned metal oxide is added to a coating solution for forming an antistatic layer, it may be added as it is and then dispersed therein. It is also preferable to add the fine particle in the form of a dispersion solution in which the fine particle is dispersed in a solvent such as water (a dispersant and a binder may be added according to the need).

The non-light-sensitive layer preferably contains the above hardened product of the above binder and a hardener, which product functions as the binder agent used to disperse and support the conductive metal oxide particle. In the present invention, it is preferable that both of the binder and the hardener which are soluble in water or in the state of an aqueous dispersion, such as an emulsion, be used with the view of maintaining a better working environment and preventing air pollution. Also, the binder preferably has any group among a methylol group, hydroxyl group, carboxyl group, and glycidyl group, to enable a crosslinking reaction with the hardener. A hydroxyl group and carboxyl group are preferable and a carboxyl group is particularly preferable. The content of the hydroxyl or carboxyl group in the binder is preferably 0.0001 to 1 equivalent/1 kg and particularly preferably 0.001 to 1 equivalent/1 kg.

Preferable resins usable as the binder will be hereinafter explained.

Examples of acrylic resins may include homopolymers of any one monomer of acrylic acids, acrylates (such as alkyl acrylates), acrylamides, acrylonitriles, methacrylic acids, methacrylates (such as alkyl methacrylates), methacrylamides, and methacrylonitriles; and copolymers obtained by polymerizing two or more of these monomers. Among these polymers or copolymers, preferred are homopolymers of any one monomer of acrylates, such as alkyl acrylates, and methacrylates, such as alkyl methacrylates, or copolymers obtained by polimerization of two or more of these monomers. Examples of these homopolymers or copolymers may include homopolymers of any one monomer of acrylates and methacrylates having an alkyl group having 1 to 6 carbon atoms, or copolymers obtained by the polymerization of two or more of these monomers.

The above acrylic resin is preferably a polymer obtained by using the above composition as its major components and by partially using a monomer having any group of, for example, a methylol group, hydroxyl group, carboxyl group, and glycidyl group, so as to enable a crosslinking reaction with the hardener.

Preferable examples of the above vinyl resin include a polyvinyl alcohol, acid-denatured polyvinyl alcohol, polyvinyl formal, polyvinyl butyral, polyvinyl methyl ether, polyolefin, ethylene/butadiene copolymer, polyvinyl acetate, vinyl chloride/vinyl acetate copolymer, vinyl chloride/(meth) acrylate copolymer, and ethylene/vinyl acetate-series copolymer (preferably an ethylene/vinyl acetate/(meth)acrylate copolymer). Among these, a polyvinyl alcohol, acid-denatured polyvinyl alcohol, polyvinyl formal, polyolefin, ethylene/butadiene copolymer and ethylene/vinyl acetate-series copolymer (preferably an ethylene/vinyl acetate/acrylate copolymer) are preferable.

Generally, in order for the above vinyl resin to be able to crosslink with the hardener, a polyvinyl alcohol, acid-denatured polyvinyl alcohol, polyvinyl formal, polyvinyl butyral, polyvinyl methyl ether, and polyvinyl acetate are respectively formed as a polymer having a hydroxyl group by, for example, leaving a vinyl alcohol unit in the polymer; and other polymers are respectively formed by partially using a monomer having any one group, for example, of a methylol group, hydroxyl group, carboxyl group, and glycidyl group.

Examples of the above polyurethane resin may include polyurethanes derived from any one of a polyhydroxy compound (e.g., ethylene glycol, propylene glycol, glycerol and trimethylol propane); an aliphatic polyester-series polyol obtained by a reaction between a polyhydroxy compound and a polybasic acid; a polyether polyol (e.g., poly(oxypropylene ether)polyol, poly(oxyethylene-propylene ether) polyol); a polycarbonate-series polyol, and a polyethylene terephthalate polyol; or those derived from a polyisocyanate and a mixture of the above. In the case of the above polyurethane resin, for instance, a hydroxyl group that is left unreacted after the reaction between the polyol and the polyisocyanate is completed, may be utilized as a functional group which can run a crosslinking reaction with the hardener.

As the above polyester resin, polymers obtained by a reaction between a polyhydroxy compound (e.g., ethylene glycol, propylene glycol, glycerol and trimethylolpropane) and a polybasic acid are generally used. In the case of the above polyester resin, for instance, a hydroxyl group or carboxyl group that is left unreacted after the reaction between the polyol and the polybasic acid is completed, may be utilized as a functional group which can run a crosslinking reaction with the hardener. Of course, a third component having a functional group such as a hydroxyl group may be added.

Among the above polymers, acrylic resins and polyurethane resins are preferable and acrylic resins are particularly preferable.

Examples of the melamine compound preferably used as the hardener include compounds having two or more (preferably three or more) methylol groups and/or alkoxymethyl groups in a melamine molecule, melamine resins which are condensation polymers of the above compounds, and melamine/urea resins. Examples of initial condensation products of melamine and formalin include, though not limited to, dimethylolmelamine, trimethylolmelamine, tetramethylolmelamine, pentamethylolmelamine, and hexamethylolmelamine. Specific examples of commercially available products of these compounds may include, though not limited to, Sumitex Resins M-3, MW, MK, and MC (trade names, manufactured by Sumitomo Chemical Co., Ltd.).

Examples of the above condensation polymer may include, though not limited to, a hexamethylolmelamine resin, trimethylolmelamine resin, and trimethyloltrimethoxymethylmelamine resin. Examples of commercially available products may include, though not limited to, MA-1 and MA-204 (trade names, manufactured by Sumitomo Bakelite), BECKAMINE MA-S, BECKAMINE APM, and BECKAMINE J-101 (trade names, manufactured by Dainippon Ink and Chemicals Inc.), Yuroid 344 (trade name, manufactured by Mitsui Toatsu Chemicals) and Oshika Resin M31 and Oshika Resin PWP-8 (trade names, manufactured by Oshika Shinko Co., Ltd.).

As the melamine compound, it is preferable that the functional group equivalence given by a value obtained by dividing its molecular weight by the number of functional groups in one molecule be 50 or more and 300 or less. Here, the functional group indicates a methylol group and/or an alkoxymethyl group. If this functional group equivalence is too large, only small cured density is obtained and hence high mechanical strength is not obtained in some cases. Then, if the amount of the melamine compound is increased, the coatability is reduced. When the cured density is small, scratches tend to be caused. Also, if the level of curing is low, the force supporting the conductive metal oxide is also reduced. When the functional group equivalence is too small, the cured density is increased but the transparency is impaired and even if the amount of the melamine compound is reduced, the condition is not bettered in some cases. The amount of an aqueous melamine compound to be added is generally 0.1 to 100 mass % and preferably 10 to 90 mass %, to the aforementioned polymer.

Matt agents, electrification adjusters, surfactants other than those as described above, lubricants, and the like may further be used in the antistatic layer, according to the need.

Examples of the matt agent include polymers and copolymers, such as a poly(methyl methacrylate) and polystyrene, and oxides, such as silicon oxide, aluminum oxide, and magnesium oxide, having a particle diameter of preferably 0.001 to 10 μm, more preferably 0.2 to 0.5 μm. The amount of the matt agent to be added is preferably 2 to 15 mg/m$^2$.

Examples of the electrification adjuster include surfactants that will be described later, polymers containing a fluorine atom, inorganic salts, and organic salts. Particularly preferred are surfactants or polymers each containing a fluorine atom, or salts containing a tetraalkylammonium ion.

Given as examples of the surfactant are known surfactants, such as anionic surfactants, cationic surfactants, amphoteric surfactants, and nonionic surfactants.

Examples of the lubricant may include phosphates of higher alcohols having 8 to 22 carbon atoms or their amino salts; palmitic acid, stearic acid and behenic acid, and their esters; and silicone-series compounds.

The thickness of the aforementioned antistatic layer is preferably 0.01 to 1 μm and more preferably 0.01 to 0.2 μm. When the thickness is too thin, coating unevenness tends to be caused on the resultant product since it is hard to apply a coating material uniformly. On the other hand, when the thickness is too thick, there is the case where inferior antistatic ability and resistance to scratching are obtained. It is preferable to dispose a surface layer on the above antistatic layer. The surface layer is provided primarily to improve lubricity and resistance to scratching, as well as to aid the ability to prevent the conductive metal oxide particles of the antistatic layer from desorbing.

Examples of materials for the above surface layer include (1) waxes, resins and rubber-like products, comprising homopolymers or copolymers of 1-olefin-series unsaturated hydrocarbons, such as ethylene, propylene, 1-butene and 4-methyl-1-pentene (e.g., a polyethylene, polypropylene, poly-1-butene, poly-4-methyl-1-pentene, ethylene/propylene copolymer, ethylene/1-butene copolymer and propylene/1-butene copolymer); (2) rubber-like copolymers of two or more types of the above I-olefin and a conjugated or non-conjugated diene (e.g., an ethylene/propylene/ethylidene norbornane copolymer, ethylene/propylene/1,5-hexadiene copolymer and isobutene/isoprene copolymer); (3) copolymers of a 1-olefin and a conjugated or non-conjugated diene (e.g., an ethylene/butadiene copolymer and ethylene/ethylidene norbornane copolymer); (4) copolymers of a 1-olefin, particularly, ethylene and vinyl acetate; and completely or partly saponified products of these copolymers; and (5) graft polymers obtained by grafting the above conjugated or non-conjugated diene or vinyl acetate on a homopolymer or copolymer of a 1-olefin; and completely or partly saponified products of these graft polymers. However, the materials for the surface layer are not limited to these compounds. The aforementioned compounds are described in JP-B-5-41656 ("JP-B" means examined Japanese patent publication).

Among these compounds, those which are polyolefins and have a carboxyl group and/or a carboxylate group are preferable. These compounds are generally used in the form of an aqueous solution or a water dispersion.

A water-soluble methyl cellulose of which the degree of methyl group substitution is 2.5 or less may be added in the surface layer, and the amount of the methyl cellulose to be added is preferably 0.1 to 40 mass % to the total binding agents forming the surface layer. The above water-soluble methyl cellulose is described in JP-A-1-210947.

The above surface layer may be formed by applying a coating solution (aqueous dispersion or aqueous solution) containing the aforementioned binder and the like, onto the antistatic layer, by using a generally well-known coating method, such as a dip coating method, air knife coating method, curtain coating method, wire bar coating method, gravure coating method or extrusion coating method.

The thickness of the above surface layer is preferably 0.01 to 1 μm and more preferably 0.01 to 0.2 μm. When the thickness is too thin, coating unevenness of the product tends to be caused because it is hard to apply the coating material uniformly. When the thickness is too thick, there is the case where the antistatic ability and resistance to scratching are inferior.

The pH of a coating film in the silver halide color photographic light-sensitive material of the present invention is preferably 4.6 to 6.4 and more preferably 5.5 to 6.5. When the pH of the coating film is too high, in a sample long under the lapse of time, a cyan image and a magenta image are greatly sensitized by irradiation with safelight. On the contrary, when the pH of the coating film is too low, the density of a yellow image largely changes with a change in the time lapsing since the light-sensitive material is exposed until it is developed. Either of the cases poses practical problems.

The pH of the coating film in the silver halide color photographic light-sensitive material of the present invention means the pH of all photographic layers obtained by applying respective coating solutions to the support, and it does not always coincide with the pH of the individual coating solution. The pH of the coating film can be measured by the following method as described in JP-A-61-245153. Specifically, (1) 0.05 ml of pure water is added dropwise to the surface of the light-sensitive material on the side to which silver halide emulsions are applied, and then (2) after the coating is allowed to stand for 3 minutes, the pH of the coating film is measured using a surface pH measuring electrode (GS-165F, trade name, manufactured by Towa Denpa). The pH of the coating film can be adjusted using an acid (e.g., sulfuric acid or citric acid) or an alkali (e.g., sodium hydroxide or potassium hydroxide), if necessary.

According to the present invention, it is possible to provide a silver halide color photographic light-sensitive material excellent in uniformity for finished photograph at a processing laboratory, in particular excellent in stability of density of white portions regardless of a storage time of the material. In particular, according to the present invention, it is possible to provide a silver halide color photographic light-sensitive material used suitably as a color positive light-sensitive material for cinema.

The present invention will be described in more detail based on the following examples, but the invention is not intended to be limited thereto.

EXAMPLES

Example 1

Preparation of a support

A polyethylene terephthalate film support (thickness: 120 μm), provided with an undercoat on the side of the surface to which emulsions were to be applied, and also provided with an acrylic resin layer which contained the following conductive polymer (0.05 g/m$^2$) and tin oxide fine particles (0.20 g/m$^2$), on the side opposite to the surface to which emulsions were to be applied, was prepared.

Electrically Conductive Polymer

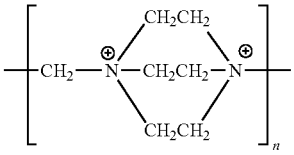

Preparation of Silver Halide Emulsions

-Preparation of Blue-Sensitive Silver Halide Emulsions-

Large-size emulsion (BO-01) (Cube, grain size 0.71 μm, grain size distribution 0.09, halogen composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $4\times10^{-7}$ mol/mol Ag. To this emulsion were added the sensitizing dyes (A') to (C') represented by the structural formulae which will be shown later, as follows.

Blue-sensitive sensitizing dye (A'): $3.5\times10^{-5}$ mol/mol Ag

Blue-sensitive sensitizing dye (B'): $1.9\times10^{-4}$ mol/mol Ag

Blue-sensitive sensitizing dye (C'): $18\times10^{-5}$ mol/mol Ag

Further, the emulsion was optimally gold-sulfur sensitized using chloroauric acid and triethylthiourea.

Middle-size emulsion (BM-01) (Cube, grain size 0.52 μm, grain size distribution 0.09, halogen composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $6\times10^{-7}$ mol/mol Ag. To this emulsion were added the sensitizing dyes (A') to (C') represented by the structural formulae which will be shown later, as follows.

Blue-sensitive sensitizing dye (A'): $6.9\times10^{-5}$ mol/mol Ag

Blue-sensitive sensitizing dye (B'): $2.3\times10^{-4}$ mol/mol Ag

Blue-sensitive sensitizing dye (C'): $2.7\times10^{31\ 5}$ mol/mol Ag

Further, the emulsion was optimally gold-sulfur sensitized using chloroauric acid and triethylthiourea.

Small-size emulsion (BU-01) (Cube, grain size 0.31 μm, grain size distribution 0.08, halogen composition Br/Cl=3/97)

This emulsion was prepared in the same manner as BM-0 1, except that, in the preparation of BM-01 emulsion, the grain formation temperature was lowered.

The sensitizing dyes (A') to (C') represented by the structural formulae which will be shown later, were added to this emulsion as follows.

Blue-sensitive sensitizing dye (A'): $8.5\times10^{-4}$ mol/mol Ag

Blue-sensitive sensitizing dye (B'): $4.1\times10^{-4}$ mol/mol Ag

Blue-sensitive sensitizing dye (C'): $3.7\times10^{-5}$ mol/mol Ag

-Preparation of Red-sensitive Silver Halide Emulsions-

Large-size emulsion (RO-01) (Cube, grain size 0.23 μm, grain size distribution 0.11, halogen composition Br/Cl=25/75)

This emulsion was prepared by addition of an aqueous silver nitrate solution and an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (D') to (F') represented by the structural formulae which will be shown later, as follows, to effect spectral sensitization.

Red-sensitive sensitizing dye (D'): $4.5\times10^{-5}$ mol/mol Ag

Red-sensitive sensitizing dye (E'): $0.2\times10^{-5}$ mol/mol Ag

Red-sensitive sensitizing dye (F'): $0.2\times10^{-5}$ mol/mol Ag

Furthermore, this emulsion was optimally gold-sulfur sensitized with chloroauric acid and triethylthiourea, and thereafter Cpd-71 represented by the structural formula which will be shown later, was added in an amount of $9.0\times10^{-4}$ mol per mol of silver halide.

Middle-size emulsion (RM-01) (Cube, grain size 0.174 νm, grain size distribution 0.12, halogen composition Br/Cl=25/75)

This emulsion was prepared in the same manner as RO-01, except that, in the preparation of RO-01 emulsion, the grain formation temperature was changed. The sensitizing dyes (D') to (F') represented by the structural formulae which will be shown later, were added to this emulsion as follows.

Red-sensitive sensitizing dye (D'): $7.0\times10^{-5}$ mol/mol Ag

Red-sensitive sensitizing dye (E'): $1.0\times10^{-5}$ mol/mol Ag

Red-sensitive sensitizing dye (F'): $0.4\times10^{-5}$ mol/mol Ag

Small-size emulsion (RU-01) (Cube, grain size 0.121 μm, grain size distribution 0.13, halogen composition Br/Cl=25/75)

This emulsion was prepared in the same manner as RO-01, except that, in the preparation of RO-01 emulsion, the grain formation temperature was changed. The sensitizing dyes (D') to (F') represented by the structural formulae which will be shown later, were added to this emulsion as follows.

Red-sensitive sensitizing dye (D'): $8.9\times10^{-5}$ mol/mol Ag

Red-sensitive sensitizing dye (E'): $1.2\times10^{-5}$ mol/mol Ag

Red-sensitive sensitizing dye (F'): $0.5\times10^{-5}$ mol/mol Ag

-Preparation of Green-Sensitive Silver Halide Emulsions-

Large-size emulsion (GO-01) (Cube, grain size 0.20 μm, grain size distribution 0.11, halogen composition Br/Cl=3/97)

This emulsion was prepared by addition of an aqueous silver nitrate solution, an aqueous mixed solution of sodium chloride and potassium bromide by the control double jet method known in the art.

The iridium content was adjusted so that it would be $2\times10^{-7}$ mol/mol Ag. To this emulsion were added the sensitizing dyes (G') to (J') represented by the structural formulae which will be shown later, as follows, to effect spectral sensitization.

Green-sensitive sensitizing dye (G'): $2.8\times10^{-4}$ mol/mol Ag

Green-sensitive sensitizing dye (H'): $0.8\times10^{-4}$ mol/mol Ag

Green-sensitive sensitizing dye (I'): $1.2\times10^{-4}$ mol/mol Ag

Green-sensitive sensitizing dye (J'): $1.2\times10^{-4}$ mol/mol Ag

Further, the emulsion was optimally gold-sulfur sensitized using chloroauric acid and triethylthiourea.

Middle-size emulsion (GM-01) (Cube, grain size 0.146 μm, grain size distribution 0.12, halogen composition Br/Cl=3/97)

This emulsion was prepared in the same manner as GO-01, except that, in the preparation of GO-01 emulsion, the grain formation temperature was changed. The sensitizing dyes (G') to (J') represented by the structural formulae which will be shown later, were added to this emulsion as follows.

Green-sensitive sensitizing dye (G'): $3.8\times10^{-4}$ mol/mol Ag

Green-sensitive sensitizing dye (H'): $1.3\times10^{-4}$ mol/mol Ag

Green-sensitive sensitizing dye (I'): $1.4\times10^{-4}$ mol/mol Ag

Green-sensitive sensitizing dye (J'): $1.2\times10^{-4}$ mol/mol Ag

Small-size emulsion (GU-01) (Cube, grain size 0.102 μm, grain size distribution 0.10, halogen composition Br/Cl=3/97)

This emulsion was prepared in the same manner as GO-01, except that, in the preparation of GO-01 emulsion, the grain formation temperature was changed. The sensitizing dyes (G') to (J') represented by the structural formulae which will be shown later, were added to this emulsion as follows.

Green-sensitive sensitizing dye (G'): $5.1\times10^{-4}$ mol/mol Ag

Green-sensitive sensitizing dye (H'): $1.7\times10^{-4}$ mol/mol Ag

Green-sensitive sensitizing dye (I'): $1.9\times10^{-4}$ mol/mol Ag

Green-sensitive sensitizing dye (J'): $1.2\times10^{-4}$ mol/mol Ag

Sensitizing dye (A')

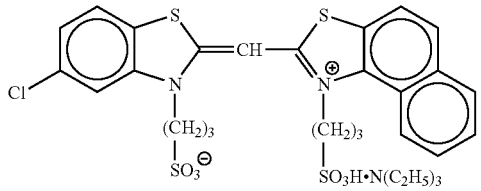

Sensitizing dye (B')

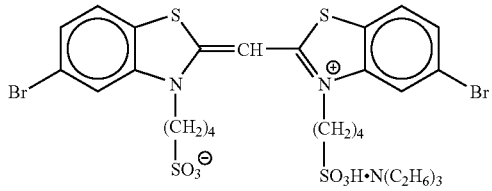

-continued

Sensitizing dye (C′)

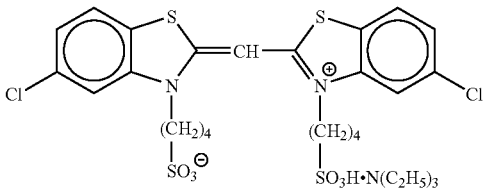

Sensitizing dye (D′)

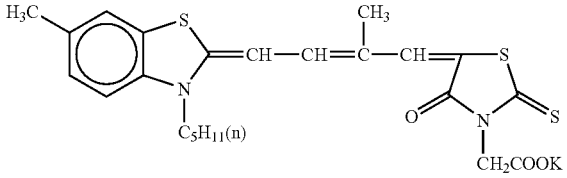

Sensitizing dye (E′)

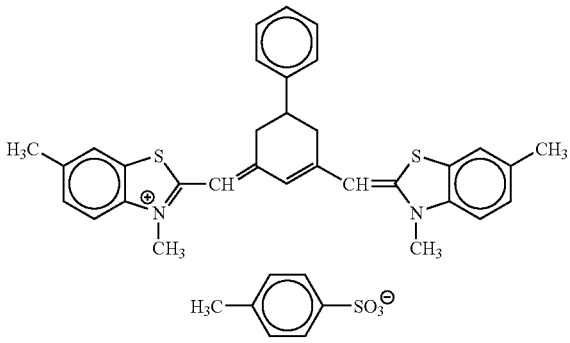

Sensitizing dye (F′)

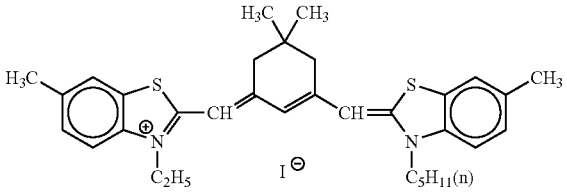

Sensitizing dye (G′)

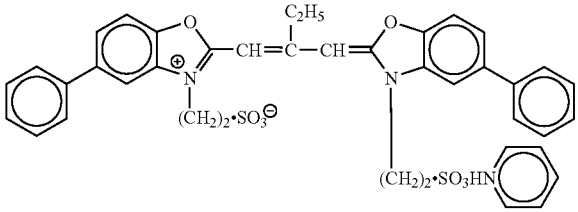

-continued

Sensitizing dye (H′)

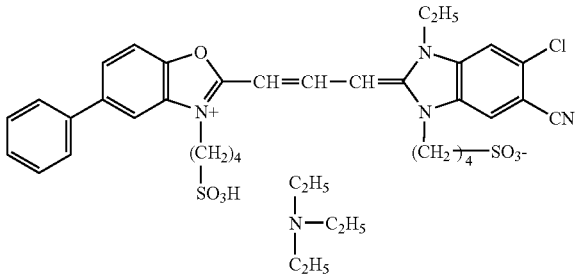

Sensitizing dye (I′)

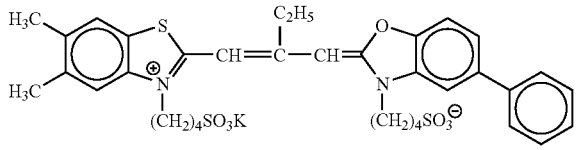

Sensitizing dye (J′)

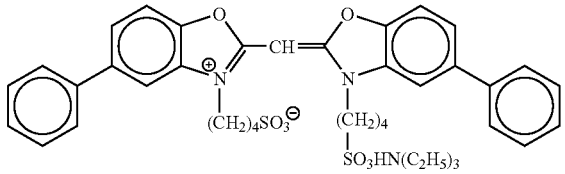

(Cpd-71)

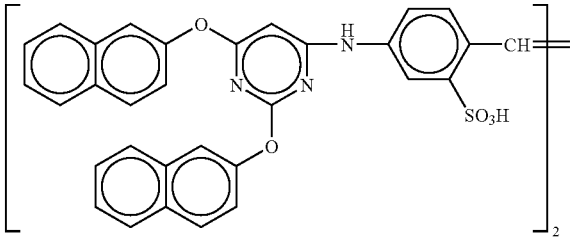

(Preparation of a Solid Fine-particle Dispersion of a Dye)

A methanol wet cake of the compound (IV-1) was weighed such that the net amount of the compound was 240 g, and 48 g of the compound (Pm-1) as a dispersing aid was weighed. To the compounds was added water such that the total amount was 4,000 g. The mixture was crushed at a discharge rate of 0.5 1/min and a peripheral velocity of 10 m/s for 2 hours by using "a flow system sand grinder mill (UVM-2)" (trade name, manufactured by AIMEX K.K.) filled with 1.7 1 of zirconia beads (diameter: 0.5 mm). Then, the dispersion was diluted such that the concentration of the compound was 3 mass %, and Compound (Pm-1) having the below shown structure was added in an amount of 3% in terms of mass ratio to the dye (this dispersion will be referred to as Dispersion A). The average particle size of this dispersion was 0.45 μm.

Further, a dispersion, which contained 5 mass % of Compound (II-25), was prepared in the same manner as above (this will be referred to as Dispersion B).

Pm-1

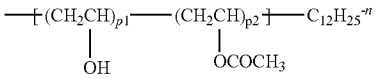

$P_1$ = 88 mol %
$P_2$ = 12 mol %
Polymerization degree 300

(Preparation of Sample 100)

Each layer having the composition shown below was applied to the support by multilayer-coating, thereby producing a multilayer color photographic light-sensitive material as Sample 100.

-Preparation of a Coating Solution for a Sixth Layer- 75.0 g of a magenta coupler (ExM'), 1.5 g of an additive (Cpd-49), 0.1 g of an additive (Cpd-51) and 2.3 g of the compound (B-1) were dissolved in 15 g of a solvent (Solv-21) and 80 ml of ethyl acetate. The solution was emulsified and dispersed in 1,000 g of an aqueous 10% gelatin solution containing 20 ml of 10% solution of the following compound (SR-1), to prepare an emulsified dispersion M.

The above emulsified dispersion M and the silver chlorobromide emulsion were mixed and dissolved using the above-described silver chlorobromide emulsions GO-01, GM-01 and GU-01, to prepare a coating solution for a sixth layer such that the solution had the following composition.

Coating solutions for first, second, third, fourth, fifth and seventh layers were prepared in the same manner as the coating solution for a sixth layer.

(SR-1)

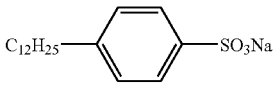

-Layer Constitution-

The composition of each layer is shown below. The numerals show the amount (g/m$^2$) to be applied. As the amount of the silver halide emulsion to be applied, an amount converted into that of silver is shown. As a gelatin hardener, a sodium salt of 1-oxy-3,5-dichloro-s-triazine was used.

(Layer Constitution of Sample 100)

Support

Polyethylene Terephthalate Film

| | |
|---|---|
| First layer (halation preventive layer (non-light-sensitive hydrophilic colloidal layer)) | |
| Gelatin | 1.03 |
| The above Dispersion A (in terms of coating amount of dye) | 0.10 |
| The above Dispersion B (in terms of coating amount of dye) | 0.03 |
| Second layer (blue light-sensitive silver halide emulsion layer) | |
| A mixture of silver chlorobromide emulsions BO-01, BM-01 and BU-01, mixed in a ratio of 3:1:6 (mol ratio of silver) | 0.57 |
| Gelatin | 2.71 |
| Yellow coupler (ExY') | 1.19 |
| (Cpd-41) | 0.0006 |
| (Cpd-42) | 0.01 |
| (Cpd-43) | 0.05 |
| (Cpd-44) | 0.003 |
| (Cpd-45) | 0.012 |

-continued

| | |
|---|---|
| (Cpd-46) | 0.001 |
| (Cpd-54) | 0.08 |
| (Cpd-65) | 0.02 |
| (SR-1) | 0.07 |
| Solvent (Solv-21) | 0.26 |
| Third Layer (Color-Mixing Inhibiting Layer) | |
| Gelatin | 0.59 |
| (Cpd-49) | 0.02 |
| (Cpd-43) | 0.05 |
| (Cpd-53) | 0.005 |
| (Cpd-61) | 0.02 |
| (Cpd-62) | 0.03 |
| (SR-1) | 0.01 |
| Solvent (Solv-21) | 0.06 |
| Solvent (Solv-23) | 0.04 |
| Solvent (Solv-24) | 0.002 |
| Fourth layer (red light-sensitive silver halide emulsion layer) | |
| A mixture of silver chlorobromide emulsions RO-01, RM-01 and RU-01, mixed in a ratio of 2:2:6 (mol ratio of silver) | 0.40 |
| Gelatin | 2.79 |
| Cyan coupler (ExC') | 0.80 |
| (Cpd-47) | 0.06 |
| (Cpd-48) | 0.06 |
| (Cpd-50) | 0.03 |
| (Cpd-53) | 0.03 |
| (Cpd-57) | 0.05 |
| (Cpd-58) | 0.01 |
| (Cpd-60) | 0.02 |
| (B-1) | 0.03 |
| (SR-1) | 0.04 |
| Solvent (Solv-21) | 0.53 |
| Solvent (Solv-22) | 0.28 |
| Solvent (Solv-23) | 0.04 |
| Fifth Layer (Color-Mixing Inhibiting Layer) | |
| Gelatin | 0.56 |
| (Cpd-49) | 0.02 |
| (Cpd-43) | 0.05 |
| (Cpd-53) | 0.005 |
| (Cpd-62) | 0.03 |
| (Cpd-64) | 0.002 |
| (SR-1) | 0.01 |
| Solvent (Solv-21) | 0.06 |
| Solvent (Solv-23) | 0.04 |
| Solvent (Solv-24) | 0.002 |
| Sixth Layer (Green Light-Sensitive silver halide Emulsion Layer) | |
| A mixture of silver chlorobromide emulsions GO-01, GM-01 and GU-01, mixed in a ratio of 1:3:6 (mol ratio of silver) | 0.54 |
| Gelatin | 1.66 |
| Magenta coupler (ExM') | 0.73 |
| (Cpd-49) | 0.013 |
| (Cpd-51) | 0.001 |
| (B-1) | 0.02 |
| (SR-1) | 0.02 |
| Solvent (Solv-21) | 0.15 |
| Seventh Layer (Protective Layer) | |
| Gelatin | 0.97 |
| Acrylic resin (av. particle diameter, 2 μm) | 0.002 |
| (Cpd-55) | 0.005 |
| (Cpd-56) | 0.08 |
| (B-1) | 0.03 |

Herein, the compounds used are shown below.
ExY′
(1)
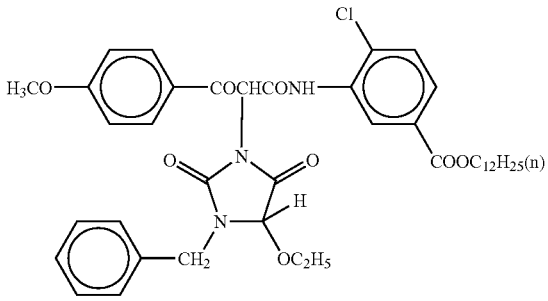
(2)
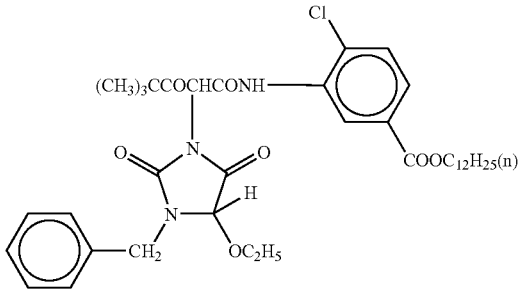
(3)
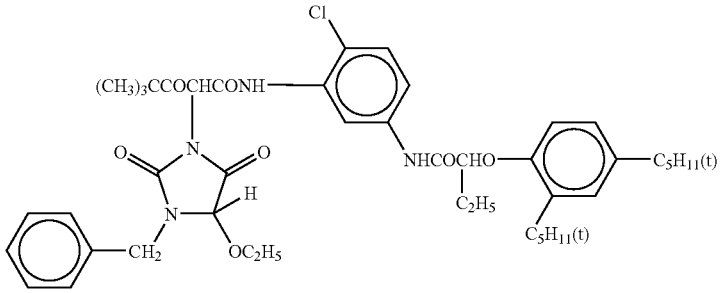
A mixture in 80:10:10 (molar ratio) of (1), (2), and (3)
ExC′
(1)
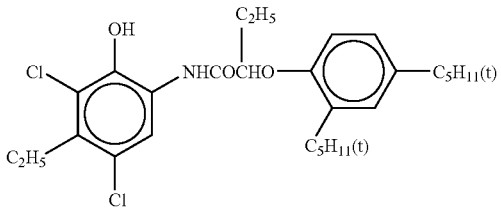
(2)
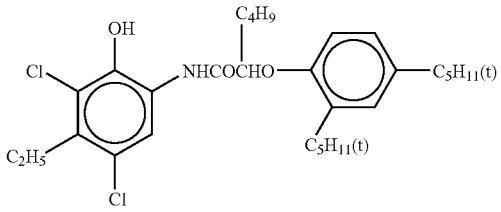
-continued
(3)
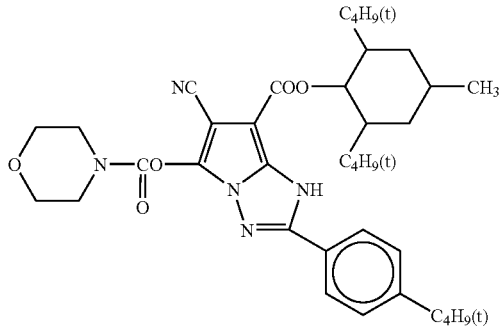

-continued
(4)
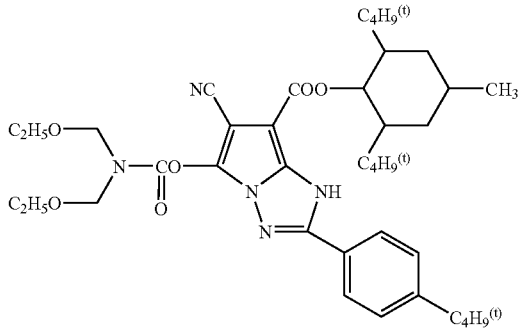
A mixture in 40:40:10:10 (molar ratio) of (1), (2), (3), and (4)
ExM′
(1)
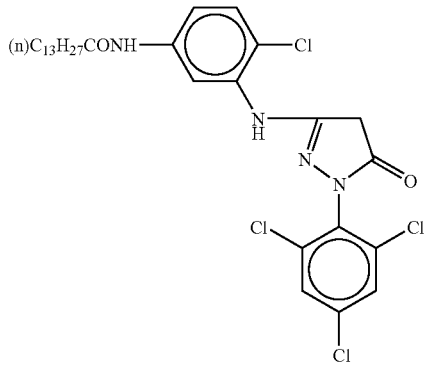
(2)
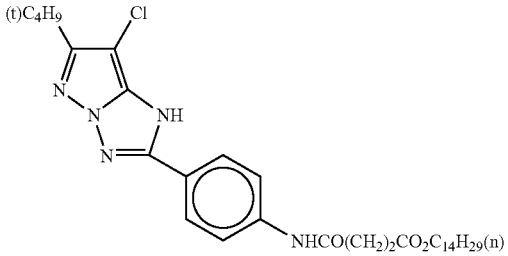
(3)
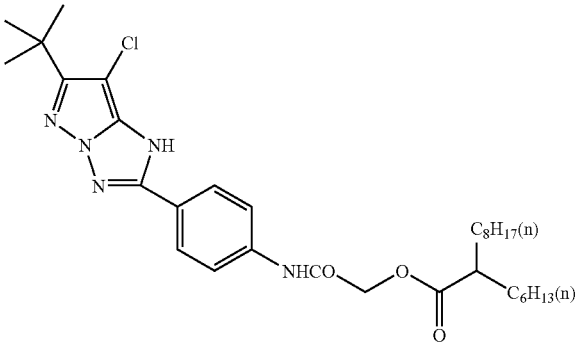
A mixture in 90:5:5 (molar ratio) of (1), (2), and (3)
(Cpd-41)
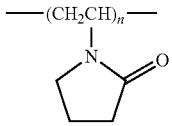
(Cpd-42)
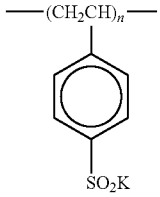
(Cpd-43)
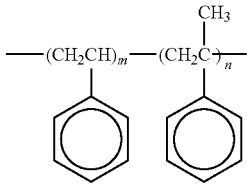
Number-average molecular weight 600
m/n = 10/90
(Cpd-44)
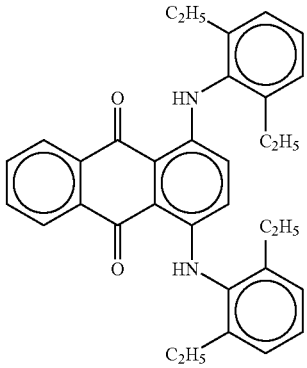
(Cpd-45)
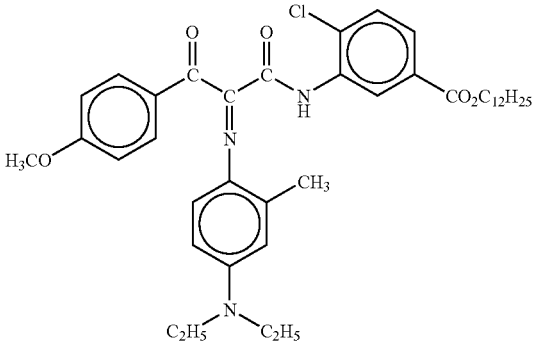

-continued
(Cpd-46)
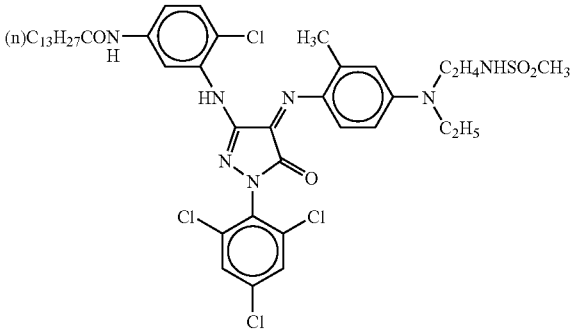
(Cpd-47)
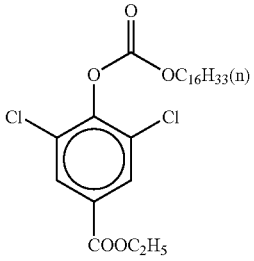
(Cpd-48)
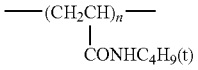
Number average molecular weight about 60,000
(Cpd-49)
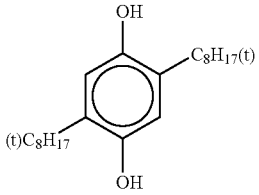
(Cpd-50)
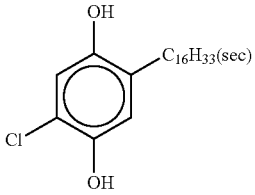
(Cpd-51)
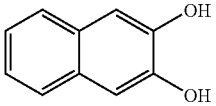
(Cpd-53)
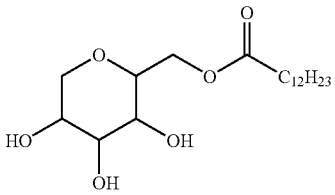
-continued
(Cpd-54)
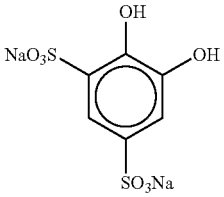
(Cpd-55)
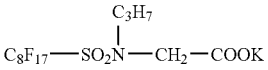
(Cpd-56)
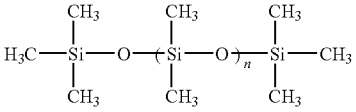
(Cpd-57)
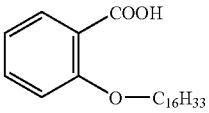
(Cpd-58)
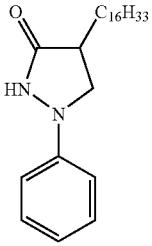
(Cpd-60)
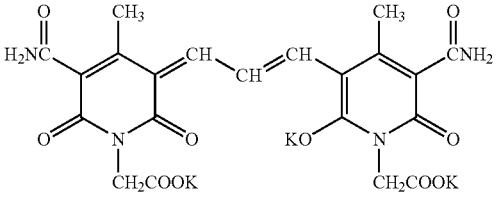
(Cpd-62)
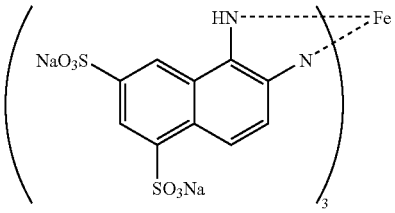
(Cpd-61)
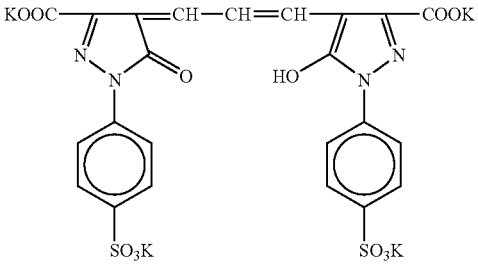

-continued (Cpd-64)

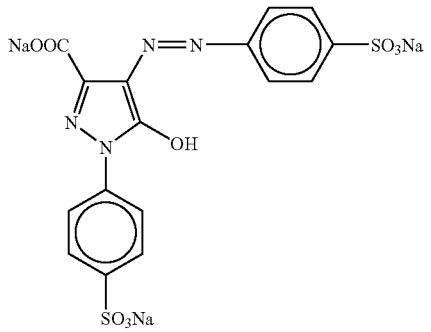

(Cpd-65)

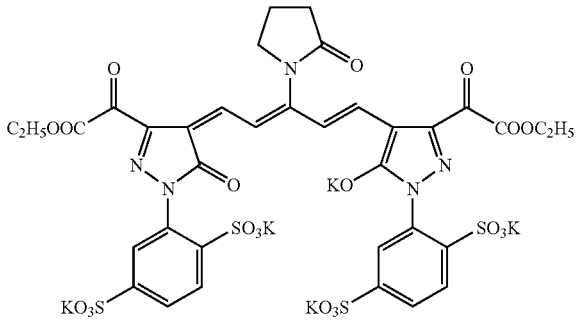

(Solv-21)

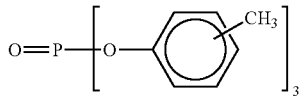

(Solv-22)

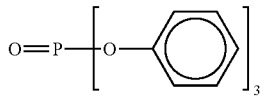

(Solv-23)

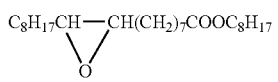

(Solv-24)

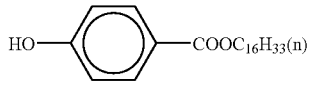

In the above manner, Sample 100 was prepared.

<Production of Samples 101 to 107>

Samples 101 to samples 107 were each produced in the same manner as in the production of the light-sensitive material 100, except that the compound (SR-1), which was the emulsifying and dispersing agent incorporated into the second, third, fourth, fifth and sixth layers, was changed to the compound or mixture as shown in Table 1. The exchange of the compound was conducted by equal mass substitution. In each of the cases where the mixture was used, equal mass substitution was conducted in a state that the two compounds was used at each ratio as shown in Table 1.

<Tests and Evaluations>

About the samples 101 to 107, the following tests and evaluations were made in order to evaluate the processing stability of white portions therein and the raw stock (unused stock) storability thereof.

-Evaluation of Color-forming Property-

A sensitometer (FW model, manufactured by Fuji Photo Film Co., Ltd., color temperature of its light source: 3,200K) was used to subject each of the samples to a gradation exposure for sensitometry at an exposure luminance of 60,000 lux, through a gray filter which would give a maximum density, in an exposure time of 1/100 second. The resultant was processed in accordance with the ECP-2 process presented by Eastman Kodak Company. A device, X-rite 310TR (trade name) manufactured by X-Rite was used to read out the highest density value of areas showing G density in the processed sample. The difference in density between each of the samples and the sample 100 (comparative example) was defined as ΔDg. This was used as an index of the color-forming property of the samples. A case where the ΔDg exhibited a positive value means that the sample had high color-forming property, and a case where the ΔDg exhibited a negative value means that the sample had poor color-forming property.

-Evaluation of White Portions and Raw Stock Storability of White Portions-

The samples 101 to 107 were stored under two respective conditions described below after the samples were prepared, and were then subjected to treatment described below.

(1) After Being Stored at 25° C. and a Relative Humidity of 55% for 7 Days, and (2) After Being Stored at 25° C. and a Relative Humidity of 55% for 300 Days.

The development time was set to 120 seconds or 240 seconds, and in accordance with the ECP-2 process presented by Eastman Kodak Company, the samples stored under each of the conditions (1) and (2) were processed in a state that the samples were not exposed to any light. The device, X-rite 310TR (trade name) manufactured by X-Rite was used to measure the minimum density value of areas showing B density in the sample processed in each of the development times. The resultant two values were defined as DminY(120) and DminY(240), respectively. ΔDminY was defined by the following equation:

$$\Delta DminY=|DminY(240)-DminY(120)|.$$

This value was used as an index representing a change in the white density (or color density) of white portions based on processing fluctuation. A case where the ΔDminY was small means that processing stability of the white portions was high.

Results of the tests about the color-forming-property and the processing stability of white portions including raw stock storability are shown in Table 1.

TABLE 1

| Sample No. | Used compound | Δ Dg | Δ DminY (7 days) | Δ DminY (300 days) | Remarks |
|---|---|---|---|---|---|
| 100 | (SR-1) | Standard | 0.025 | 0.035 | Comparative example |
| 101 | (A-1) | +0.05 | 0.010 | 0.011 | This invention |
| 102 | (B-1) | +0.03 | 0.012 | 0.014 | This invention |
| 103 | (A-1):(B-1) = 1:1 | +0.03 | 0.008 | 0.010 | This invention |
| 104 | (A-1):(B-1) = 2:1 | +0.03 | 0.008 | 0.008 | This invention |

TABLE 1-continued

| Sample No. | Used compound | Δ Dg | Δ DminY (7 days) | Δ DminY (300 days) | Remarks |
|---|---|---|---|---|---|
| 105 | (A-2) | ±0.00 | 0.016 | 0.019 | This invention |
| 106 | (B-1):(A-2) = 1:1 | ±0.00 | 0.014 | 0.017 | This invention |
| 107 | (SR-1):(A-1) = 1:1 | −0.05 | 0.024 | 0.030 | Comparative example |

From Table 1, it is understood that when the compounds as defined in the present invention were used, the white portion was suppressed for the fluctuation without decrease in color density and further the white portion processing fluctuation after the raw stock storability also became better.

Example 2

Samples were prepared in the same manner as the light-sensitive materials 101 to 107 as produced in Example 1, except that the compound (Cpd-55) added to the seventh layer was subjected to equal mass substitution to the compound (FS-1). As a result, the light-sensitive materials of the present invention exhibited advantageous effects, as in those of the present invention in Example 1.

Example 3

Samples were prepared in the same manner as the light-sensitive materials 101 to 107 as produced in Example 1, except that the counter ion of the compound (Cpd-55) added to the seventh layer was substituted with a tetraethylammonium ion. In addition, samples were prepared in the same manner as the light-sensitive materials as produced in Example 2, except that the counter ion of the compound (FS-1) added to the seventh layer was substituted with a tetraethylammonium ion. As a result, the light-sensitive materials of the present invention exhibited advantageous effects, as in those of the present invention in Example 1.

Example 4

Samples were prepared in the same manner as in Examples 1 to 3, except that the support was changed to a support described below. The obtained samples were evaluated in the same manner as in Example 1. As a result, the light-sensitive materials of the present invention exhibited advantageous effects, as in those of the present invention in Example 1.

-Preparation of Support-

Prepared was a polyethylene terephthalate film (PET film) of 120 μm thickness, both surfaces of which were subjected to a corona discharge treatment after biaxial drawing of the film. An undercoat composed of a styrene/butadiene copolymer and gelatin was applied onto the surface of the film where an emulsion layer was to be formed, and an acrylic resin layer was applied onto the surface opposite to the above-mentioned surface. The acrylic resin layer contained antimony-containing tin oxide fine particles, a matting agent comprising a polymethacrylate resin, a matting agent comprising colloidal silica, and a compound wherein the counter ion of the compound (FS-1) was substituted with a tetraethylammonium ion.

Having described our invention as related to the present embodiments, it is our intention that the invention not be limited by any of the details of the description, unless otherwise specified, but rather be construed broadly within its spirit and scope as set out in the accompanying claims.

What is claim is:

1. A silver halide color photographic light-sensitive material, comprising, on a transmission support, at least one yellow-color-forming light-sensitive silver halide emulsion layer, at least one cyan-color-forming light-sensitive silver halide emulsion layer, at least one magenta-color-forming light-sensitive silver halide emulsion layer, and at least one non-light-sensitive hydrophilic colloidal layer, wherein the at least one non-light-sensitive hydrophilic colloidal layer comprises a solid fine-particle dispersion of a dye represented by formula (I), wherein any one of the light-sensitive silver halide emulsion layers and the non-light-sensitive hydrophilic colloidal layer comprises at least one compound represented by formula (A) and/or at least one compound represented by formula (B), and wherein the silver halide color photographic light-sensitive material does not comprise any compound represented by formula (C):

$$D-(X)_y \qquad \text{Formula (I)}$$

wherein, in formula (I), D represents a group to give a compound having a chromophore; X represents a dissociable hydrogen or a group having a dissociable hydrogen; and y is an integer from 1 to 7;

Formula (A)

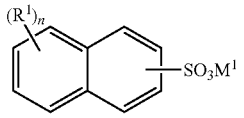

wherein, in formula (A), R1 represents a substituted or unsubstituted alkyl or alkoxy group; M1 represents a cation; and n represents an integer of 1 to 7;

Formula (B)

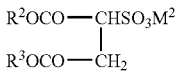

wherein, in formula (B), R2 and R3 each independently represent a substituted or unsubstituted alkyl group, and M2 represents a cation; and Formula (C)

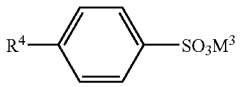

wherein, in formula (C), $R^4$ represents a substituted or unsubstituted alkyl group, and $M^3$ represents a cation.

2. The silver halide color photographic light-sensitive material according to claim 1, wherein the at least one compound represented by formula (B) is a compound represented by formula (FS-1);

Formula (FS-1)

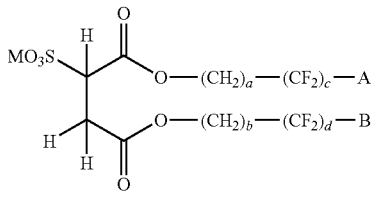

wherein, A and B each independently represent a fluorine atom or a hydrogen atom; a and b each independently represent an integer of from 1 to 6; c and d each independently represent an integer of from 4 to 8; x represents 0 or 1; and M represents a cation.

3. The silver halide color photographic light-sensitive material according to claim 1, wherein the dye represented by formula (I) is a dye represented by formula (II) or (III):

$$A^1=L^1-(L^2L^3)_{m1}-Q \quad \text{Formula (II)}$$

wherein, in formula (II), $A^1$ represents an acidic nucleus, Q represents an aryl group or a heterocyclic group, $L^1$, $L^2$ and $L^3$ each independently represents a methine group, m1 denotes 0, 1 or 2, and the dye represented by formula (II) has, in its molecule, 1 to 7 groups selected from the group consisting of a carboxylic acid group, sulfonamido group, sulfamoyl group, sulfonylcarbamoyl group, acylsulfamoyl group, phenolic hydroxyl group, and enol group of an oxonol dye; and $$A^1=L^1-(L^2=L^3)_{n1},-A^2 \quad \text{Formula (III)}$$

wherein, in formula (III), $A^1$ and $A^2$ each independently represents an acidic nucleus, $L^1$, $L^2$ and $L^3$ each independently represents a methine group, n1 denotes 0, 1, 2 or 3, and the dye represented by formula (III) has, in its molecule, 1 to 7 groups selected from the group consisting of a carboxylic acid group, sulfonamido group, sulfamoyl group, sulfonylcarbamoyl group, acylsulfamoyl group, phenolic hydroxyl group, and an enol group of an oxonol dye.

4. The silver halide color photographic light-sensitive material according to claim 1, wherein $R^1$ in formula (A) is a substituted or unsubstituted alkyl or alkoxy group having 1 to 6 carbon atoms.

5. The silver halide color photographic light-sensitive material according to claim 1, wherein $M^1$ in formula (A) is lithium ion, sodium ion, potassium ion or ammonium ion.

6. The silver halide color photographic light-sensitive material according to claim 1, wherein the compound represented by formula (C) is sodium p-hexylbenzenesulfonate, potassium p-octylbenzenesulfonate, sodium p-dodecylbenzenesulfonate, or sodium p-tridecylbenzenesulfonate.

7. A silver halide color photographic light-sensitive material, comprising, on a transmission support, at least one yellow-color-forming light-sensitive silver halide emulsion layer, at least one cyan-color-forming light-sensitive silver halide emulsion layer, at least one magenta-color-forming light-sensitive silver halide emulsion layer, and at least one non-light-sensitive hydrophilic colloidal layer, wherein the at least one non-light-sensitive hydrophilic colloidal layer comprises a solid fine-particle dispersion of a dye represented by formula (I), wherein any one of the light-sensitive silver halide emulsion layers and the non-light-sensitive hydrophilic colloidal layer comprises at least one compound represented by formula (A) and/or at least one compound represented by (FS-2), and wherein the silver halide color photographic light-sensitive material does not comprise any compound represented by formula (C):

$$D-(X)_y \quad \text{Formula (I)}$$

wherein, in formula (I), D represents a group to give a compound having a chromophore;

X represents a dissociable hydrogen or a group having a dissociable hydrogen; and y is an integer from 1 to 7;

Formula (A)

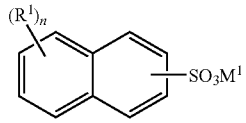

wherein, in formula (A), $R^1$ represents a substituted or unsubstituted alkyl or alkoxy group; $M^1$ represents a cation; and n represents an integer of 1to 7;

Formula (FS-2)

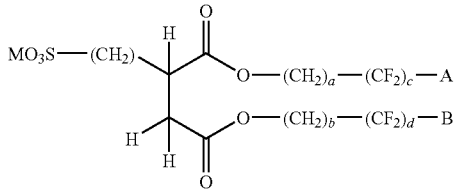

wherein, in formula (FS-2), A and B each independently represent a fluorine atom or a hydrogen atom; a and b each independently represent an integer of from 1 to 6; c and d each independently represent an integer of from 4 to 8; and M represents a cation; and Formula(C)

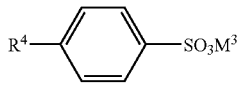

wherein, in formula (C), $R^4$ represents a substituted or unsubstituted alkyl group, and $M^3$ represents a cation.

8. The silver halide color photographic light-sensitive material according to claim 7, wherein the dye represented by formula (I) is a dye represented by formula (II) or (III):

$$A^1=L^1-(L^2=L^3)_{m1}-Q \quad \text{Formula (II)}$$

wherein, in formula (II), A represents an acidic nucleus, Q represents an aryl group or a heterocyclic group, $L^1$, $L^2$ and $L^3$ each independently represents a methine group, m1 denotes 0, 1 or 2, and the dye represented by formula (II) has, in its molecule, 1 to 7 groups selected from the group consisting of a carboxylic acid group, sulfonamido group, sulfamoyl group, sulfonylcarbamoyl group, acylsulfamoyl group, phenolic hydroxyl group, and enol group of an oxonol dye; and $$A^1=L^1-(L^2=L^3)_{n1}-A^2 \quad \text{Formula (III)}$$

wherein, in formula (III), $A^1$ and $A^2$ each independently represents an acidic nucleus, $L^1$, $L^2$ and $L^3$ each independently represents a methine group, n1 denotes 0, 1, 2 or 3, and the dye represented by formula (III) has, in its molecule, 1 to 7 groups selected from the group consisting of a carboxylic acid group, sulfonamido group, sulfamoyl group, sulfonylcarbamoyl group, acylsulfamoyl group, phenolic hydroxyl group, and an enol group of an oxonol dye.

9. The silver halide color photographic light-sensitive material according to claim 7, wherein $R^1$ in formula (A) is a substituted or unsubstituted alkyl or alkoxy group having 1 to 6 carbon atoms.

10. The silver halide color photographic light-sensitive material according to claim 7, wherein $M^1$ in formula (A) is lithium ion, sodium ion, potassium ion or ammonium ion.

11. The silver halide color photographic light-sensitive material according to claim 7, wherein the compound represented by formula (C) is sodium p-hexylbenzenesulfonate, potassium p-octylbenzenesulfonate, sodium p-dodecylbenzenesulfonate, or sodium p-tridecylbenzenesulfonate.

* * * * *